US006138426A

United States Patent [19]

Mork et al.

[11] Patent Number: 6,138,426

[45] Date of Patent: Oct. 31, 2000

[54] MORTARLESS WALL

[76] Inventors: Robert James Mork, 559 Panther Creek Rd., Sevierville, Tenn. 37876; Robert John Mork, 203 McCameron St., Lockport, Ill. 60441

[21] Appl. No.: 09/276,226

[22] Filed: Mar. 25, 1999

Related U.S. Application Data

[63] Continuation-in-part of application No. 08/968,807, Nov. 22, 1997, abandoned.

[51] Int. Cl.[7] ..... E04B 1/02; E04C 3/30

[52] U.S. Cl. ..... 52/562; 52/561; 52/600; 52/604; 52/605; 52/293.2; 52/293.3; 52/586.1; 52/586.2

[58] Field of Search ..... 52/600, 604, 605, 52/293.2, 293.3, 586.1, 586.2, 561, 562

[56] References Cited

U.S. PATENT DOCUMENTS

| | | | |
|---|---|---|---|
| 830,094 | 9/1906 | Momsen | 62/600 |
| 990,119 | 4/1911 | Diamond | 52/293.2 |
| 2,141,397 | 12/1938 | Locke | 52/293.2 |
| 2,153,913 | 4/1939 | Blackwell . | |
| 3,309,827 | 3/1967 | Nicosia . | |
| 3,650,079 | 3/1972 | Lubin . | |
| 3,968,615 | 7/1976 | Ivany . | |
| 3,998,022 | 12/1976 | Muse . | |
| 4,110,949 | 9/1978 | Cambiuzzi et al. | 52/605 |
| 4,148,166 | 4/1979 | Toone | 52/604 |
| 4,182,089 | 1/1980 | Cook | 52/293.2 |
| 4,315,391 | 2/1982 | Piazza | 52/293.2 |
| 4,565,043 | 1/1986 | Mazzarese . | |
| 5,282,700 | 2/1994 | Rodrique | 52/605 |
| 5,528,873 | 6/1996 | Correia et al. | 52/605 |
| 5,687,531 | 11/1997 | Nelson et al. | 52/604 |

FOREIGN PATENT DOCUMENTS

| | | | |
|---|---|---|---|
| 143285 | 8/1980 | Germany | 52/604 |

*Primary Examiner*—Beth A. Stephan
*Assistant Examiner*—Dennis L. Dorsey
*Attorney, Agent, or Firm*—Cheskov & Flaynik

[57] ABSTRACT

A mortarless wall 200 is constructed from blocks 201 having upper and lower recesses 202 positioned at a longitudinal centerline in upper and lower walls 206 to form channels that receive alignment rails 212 that extend across entire tiers 214 and 215 of aligned blocks 201 thereby securing and stabilizing each tier of blocks 201 via both top and bottom walls 206 of each block 201.

13 Claims, 23 Drawing Sheets

MORTARLESS WALL

This is a Continuation-In-Part application of prior application Ser. No. 08/968,807 that was filed on Nov. 22, 1997 now abandoned.

BACKGROUND OF THE INVENTION

1. Field of the Invention

The present invention relates generally to building blocks for constructing a wall and more particularly, to building blocks for constructing a wall without mortar.

2. Background of the Prior Art

Constructing a wall fabricated from bricks or building blocks (cinder blocks) using mortar is well known to those of ordinary skill in the art. Generally, a block wall is assembled by first placing a layer of mortar upon the surface of a foundation. The blocks are then individually positioned in the mortar by a person such that a one-half inch layer of mortar is between each block and the foundation, and a one-half inch thick section of mortar separates end walls of adjacently positioned blocks to form a first tier of blocks conforming to the foundation design. The blocks are aligned and leveled by the individual by tapping upon respective upper, side or end walls until adjacent blocks are linearly arranged. This process is obviously very time consuming and expensive. Also, although mortar surrounds each individual block, the top tiers of blocks in the completed wall can be easily pulled over. Thus, the only purpose for the mortar is to provide a means to level and align the blocks, and to provide a barrier that prevents moisture from seeping between adjacently positioned blocks.

Prior art building blocks utilize mortar for alignment and/or leveling, pilasters extending through aligned internal block cavities that traverse the entire wall elevation for strength and stability, or a combination of both resulting in a very expensive and time consuming project. Examples of such building blocks are illustrated in U.S. Pat. Nos. 4,565,043; 3,998,022; 3,968,615; 3,650,079; 3,309,827; and 2,153,913.

Unfortunately, these block designs are of no use when constructing a block wall without mortar from a foundation to a predetermined elevation while maintaining alignment, level, strength and stability along with a moisture barrier between adjacent blocks.

A need exists in the art for the inexpensive and fast construction of a wall comprised of building blocks such that the quality of the wall is not diminished.

SUMMARY OF THE INVENTION

It is an object of the present invention to provide a building block to construct a wall that overcomes many of the disadvantages of the prior art.

A principal object of the present invention is to provide a building block to construct a wall quickly and inexpensively. A feature of the building block is that it requires no mortar to construct the wall. An advantage of the building block is that an individual specially skilled in applying mortar between adjacent blocks is not required.

Another object of the present invention is to provide a starter strip to align and level a first tier of building blocks on a foundation. A feature of the invention is a locator that congruently engages a beveled lower edge of the building block. An advantage is that the building blocks are quickly positioned in a straight line such that adjacent end walls are in congruent physical contact. Another feature of the invention is a plurality of locator pegs that insert into a passageway or recess in a lower wall of the building block. An advantage is that the building block maintains its position even when struck by a second adjacently positioned block on the strip.

Yet another object of the present invention is to provide a corner starter section. A feature of the invention is a locator that positions an end wall of a first block adjacent to the side wall of a second block. An advantage is that a corner portion of a first tier of blocks is quickly formed.

Still another object of the present invention is to provide a block having side walls with beveled longitudinal and lateral edges. A feature of the present invention is to provide a method of sealing the perimeters of adjacently positioned blocks. An advantage of sealing the perimeters is that a moisture barrier is formed.

Another object of the present invention is to provide a block slightly larger than a conventional building block. A feature of the invention is to enlarge respective side walls of a block to "make-up" for the gap dimensions formed between adjacent blocks when using mortar to construct a wall. An advantage is that the quantity of blocks used to form a mortarless wall is the same as the quantity of smaller blocks to form a wall with mortar.

Still another object of the present invention is to provide strength and stability to a mortarless wall. A feature of the invention is two lugs extending from an upper wall of the block in a first tier, and two passageways in a lower wall of a block positioned and staggered upon two blocks in the first tier so as to snugly receive cooperating lugs in the passageways. An advantage of the interlocking lugs and passageways is that successive tiers of blocks are quickly and inexpensively positioned without the need for pilasters traversing the elevation of the wall.

Briefly, the invention provides a mortarless wall comprising a plurality of building blocks configured into horizontally extending tiers of blocks resting one upon another, the block of each tier being in staggered relation to blocks of adjacent upper and lower tiers of blocks, said blocks having an upper wall with at least one interlocking portion extending therefrom and a lower wall with a recess therein, said interlocking portion being inserted into a recess in the lower wall of a staggered block in an upper adjacent tier, said recess receiving an extending interlocking portion of a staggered block in a lower adjacent tier; means for leveling a top wall of a foundation upon which a first tier of said blocks is positioned; means for horizontally aligning said first tier of blocks upon said leveling means on said top wall of said foundation; means for aligning outer planar vertical side walls of said blocks of each successive tier of blocks forming said mortarless wall; and means for sealing longitudinal and lateral edges of said outer side walls of said blocks to prevent moisture from seeping between adjacently positioned blocks.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
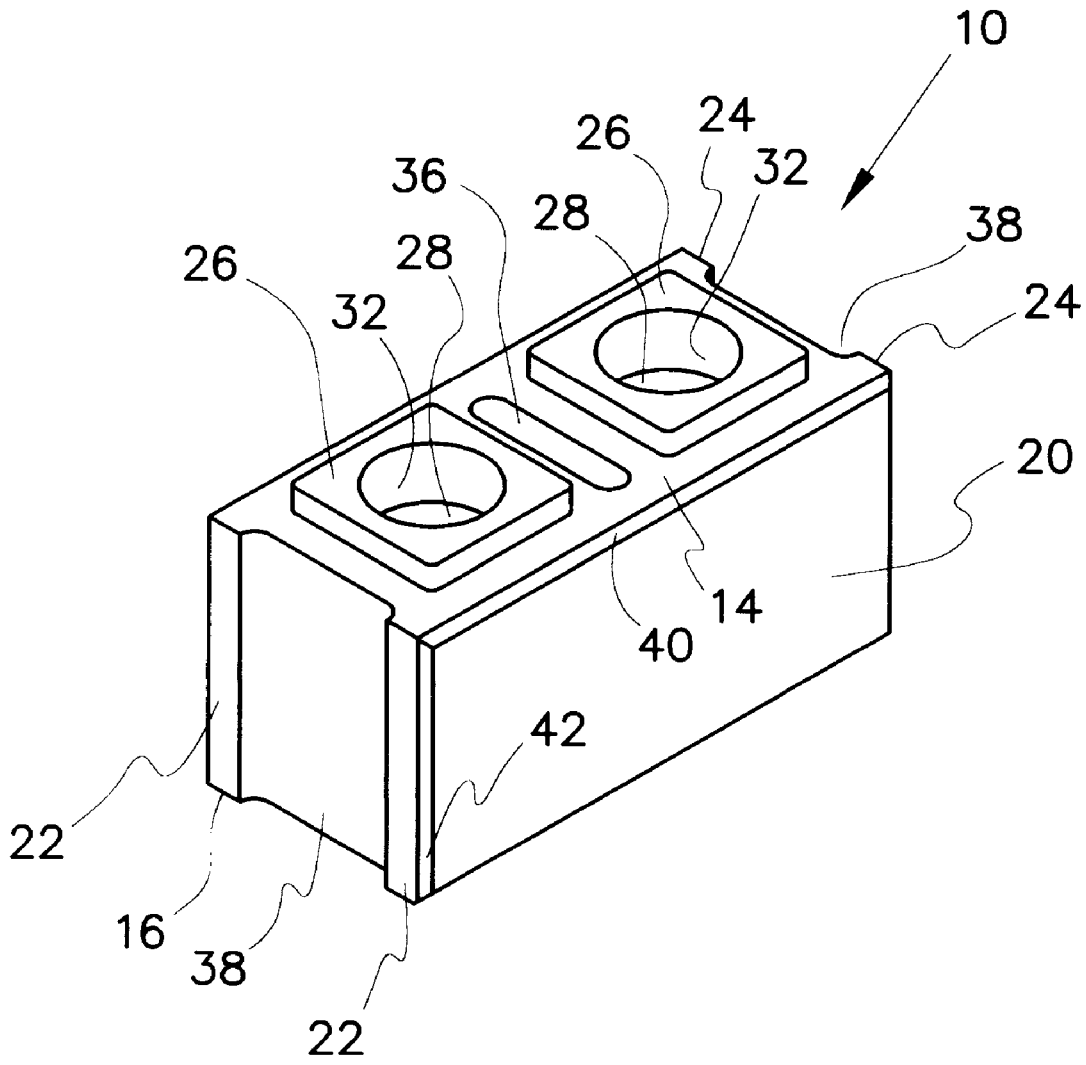
FIG. 1 is a perspective view of a building block for constructing a mortarless wall in accordance with the present invention.
Figure 5:
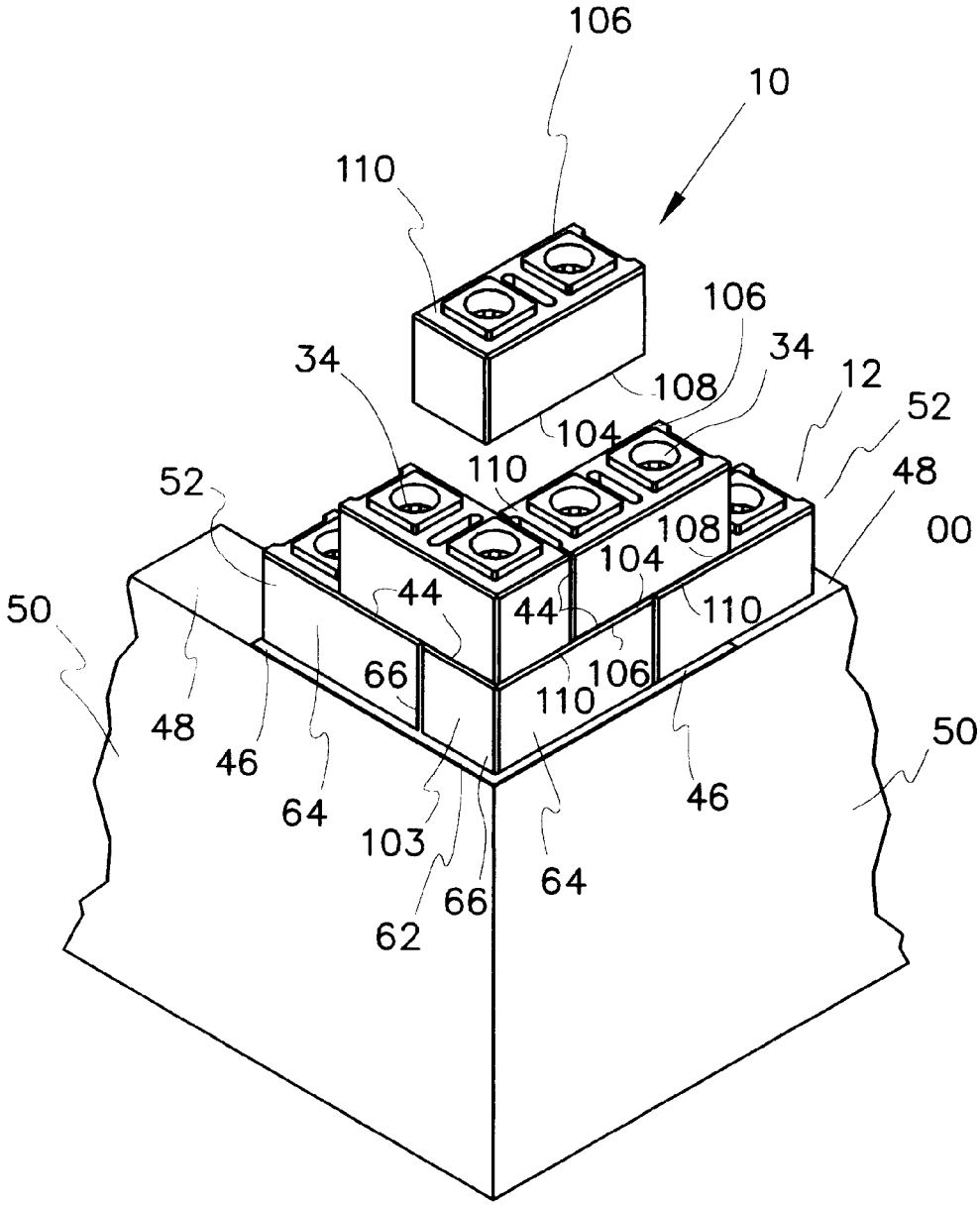
FIG. 5 is a perspective view of a mortarless wall constructed of building blocks in accordance with the present invention.

In the illustrations given and more particular to FIG. 1 of the reference numeral 10 designates generally a building block for constructing a mortarless wall 12 (see FIG. 5) in conformance with the present invention. The block 10 includes horizontal upper and lower congruent, parallel, planar walls 14 and 16, vertical inner and outer congruent, parallel, planar side walls 18 and 20, and vertical first and second congruent, parallel, planar end walls 22 and 24.

The block 10 may be fabricated from a myriad of materials including wood, plastic, cement, clay or of compositions similar to a conventional cinderblocks or bricks. The configuration of the block 10 of the present embodiment is substantially the same as a conventional cinderblock; however, the dimensions of the block 10 are slightly larger than the corresponding dimensions of a conventional cinderblock. More specifically, a convention cinderblock measures fifteen and one-half inches in length, seven and one-half inches in height and seven and three-quarters inches in width. The corresponding dimensions of the block 10 of the present invention measure sixteen inches in length, eight inches in height and seven and three-quarters inches in width. The increased dimensions in length and heighth are to compensate for the lack of mortar between adjacent blocks. The typical mortar thickness between adjacent conventional blocks and bricks is one-half inch which is compensated for by increasing the block of the present invention by one-quarter inch in length and heighth. The block's 10 thickness, the distance between the first and second side walls 18 and 20, remains equal to the thickness of a conventional block. The increased dimensions of the block 10 of the present invention, enables the block 10 to replace without mortar conventional blocks surrounded by mortar to construct a wall. Thus, the quantity of blocks 10 of the present invention to build a mortarless wall of predetermined dimensions would be equal to the quantity of conventional blocks with mortar surrounding each conventional block to construct a wall with the same predetermined dimensions.

Figure 2:
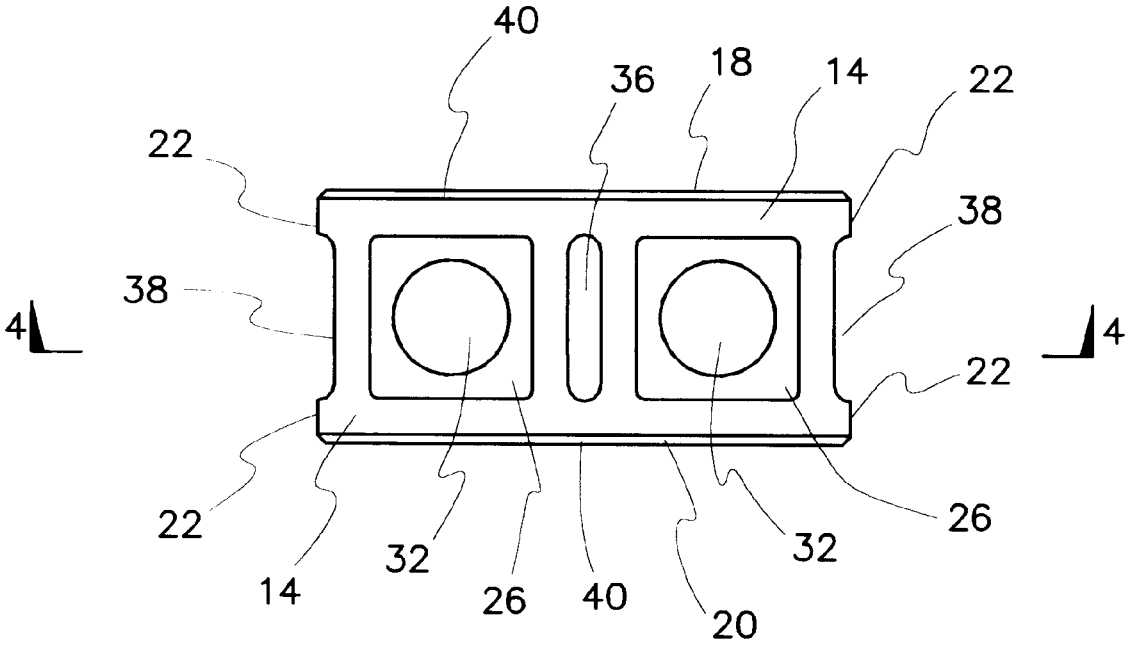
FIG. 2 is a top elevation view of the building block depicted in FIG. 1.
Figure 3:
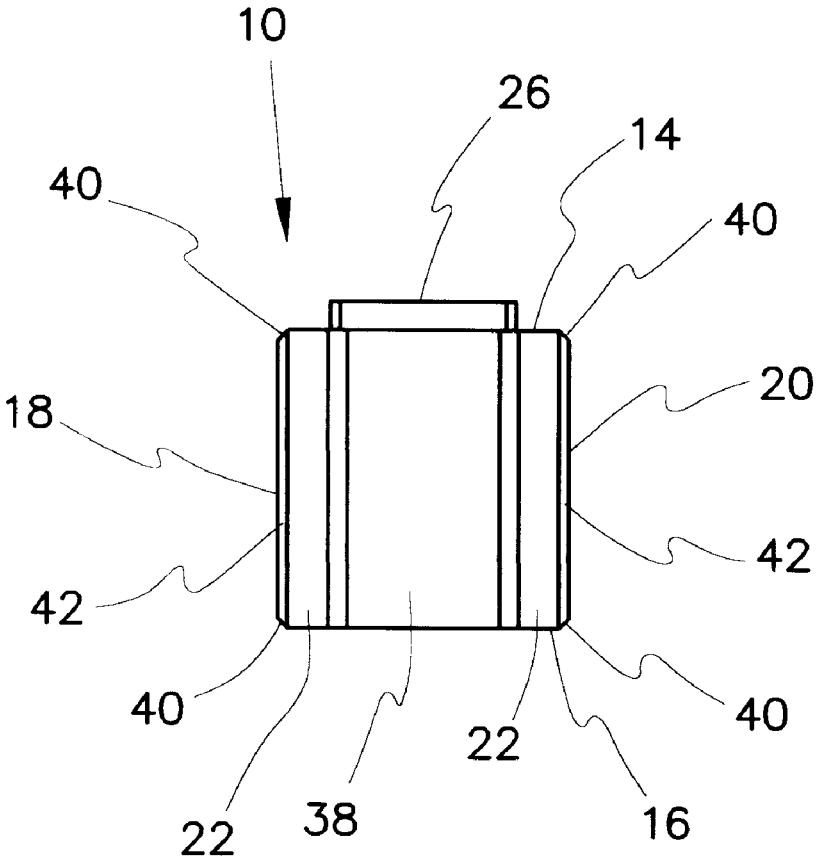
FIG. 3 is an end elevation view of the building block depicted in FIG. 1.
Figure 4:
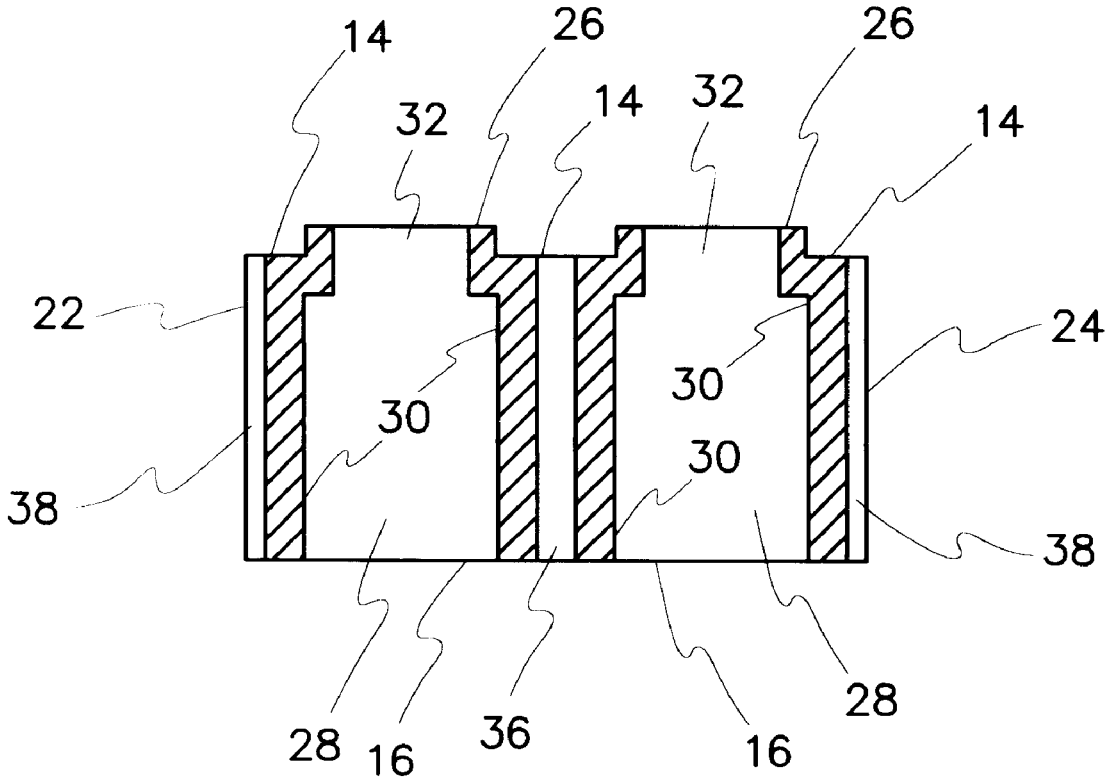
FIG. 4 is a side sectional view taken along line 4—4 of FIG. 2.
Figure 4A:
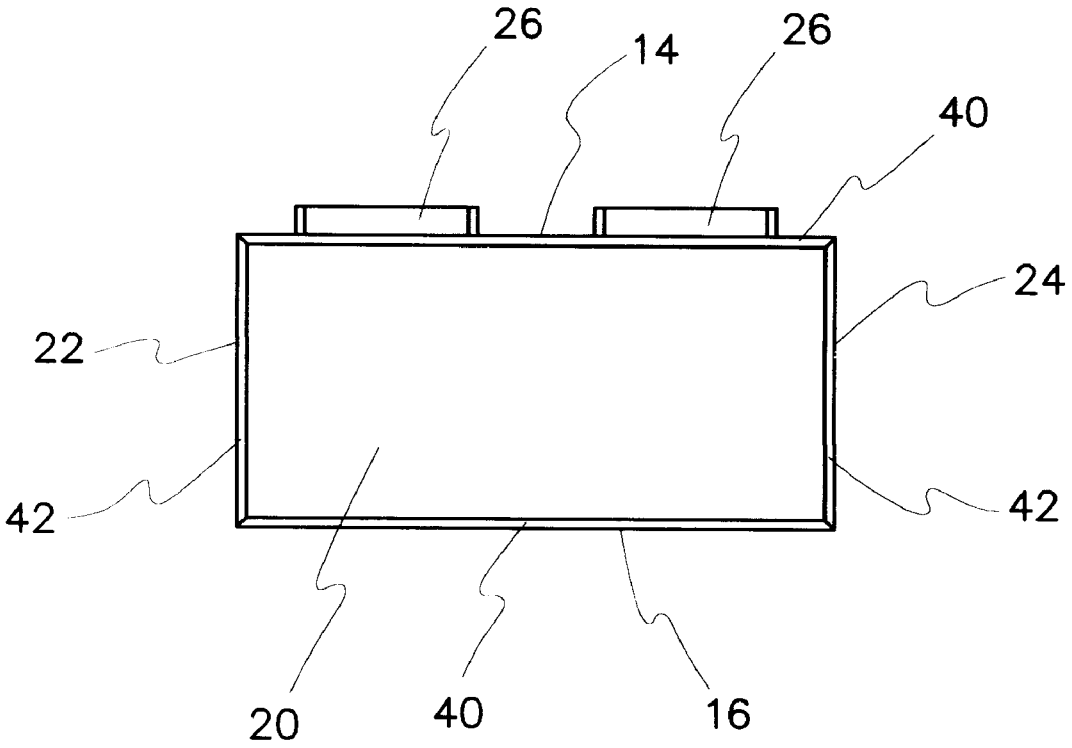
FIG. 4A is a side elevation view of the building block depicted in FIG. 1.

Referring to FIGS. 1, 2 and 4, a perspective view, a top elevation view and a side sectional view taken along line 4—4 depict a building block 10 in accordance with the present invention. The block 10 is configured substantially the same as a conventional block except for the increased dimensions as detailed above and two lugs 26 extending above the upper wall 14 of the block 10. The block 10 includes two vertical passageways 28 (see FIG. 4) extending from the lower wall 16 to the upper wall 14. The passageways 28 have a substantially square configuration when taking a bottom elevation view (see FIG. 3) of the block 10. An extension lug 26 is integrally joined to each of the four internal side walls 30 of each passageway 28. Alternatively, the extension lugs 26 may be an integral extension of the upper wall of the block 10 thereby making the entire block a single unit construction. The extension lug 26 has a substantially square perimeter configuration when taking a top elevation view (see FIG. 2). The extension lugs 26 are designed to snugly extend into the passageways 28 via the lower wall 16 of an adjacent upper block 10 such that the upper planar wall 14 of a lower tier block physically contacts the lower planar wall 16 of an upper tier block thereby interlocking the two vertically adjacent blocks 10 to provide strength and stability to the mortarless wall 12.

The passageways 28, although extending vertically through the entire block 10, need only be recessed enough to receive the entire lug 26. However, by having the passageway 28 traverse the entire block 10, the lugs 26 vertical extension may be varied to correspond to the required interlocking strength required by the wall 12. Further, a passageway 28 through the entire block 10, reduces the weight of the block and the cost of manufacture.

The extension lugs 26 include an orifice 32 axially aligned with the passageway 28. The orifice 32 serves the dual purpose of further reducing the weight of the block 10, and more important, providing an opening through the lug 26 that joins with the block passageway 28 to provide a vertical opening through the entire block 10 that would otherwise be sealed off once the lugs 26 are secured to the passageway side walls 30. Upon assembling a mortarless wall 12 (see FIG. 5), the aligned blocks 10 form a plurality of vertical wall passageways 34 through the entire mortarless wall 12. The wall passageways may be utilized to increase wall strength and stability by inserting pipes, concrete or other structures through the entire elevation of the mortarless wall 12.

The block 10 further includes a recess 36 extending from the upper wall 14 to the lower wall 16 to further reduce the weight of the block 10 and to provide an easy "split" or fracture point to break the block 10 into two pieces. The first and second end walls 22 and 24 of the block 10 include a recess 38 that has a substantially square configuration when taking an elevation view of either end of the block. The recesses 38 traverse the block from the lower to upper walls 16 and 14, and includes a substantial surface area of the block end walls 22 and 24. The recesses 38 provides a relatively slight depression into the end walls 22 and 24 to further reduce the weight of the block and to provide a means for an individual to relatively easily lift and carry the block 10.

The inner and outer side walls 18 and 20 of the block 10 have beveled longitudinal and lateral edges 40 and 42 that, when positioned to corresponding edges of adjacent blocks 10, form V-shaped recesses or grooves 44 (see FIG. 5) around the perimeter of each block 10 that forms the mortarless wall 12. The grooves 44 receive a caulking compound to seal the gaps between the blocks 10 and to prevent moisture from seeping between adjacently positioned blocks. Although only the outer side wall 20 of the block 10 receives the caulking compound thereby requiring only one side wall to be beveled, both inner and outer side walls 18 and 20 have beveled edges to prevent a careless person assembling the mortarless wall 12, from positioning a block 10 such that the exposed outer side wall has no beveled edges.

Figure 6:
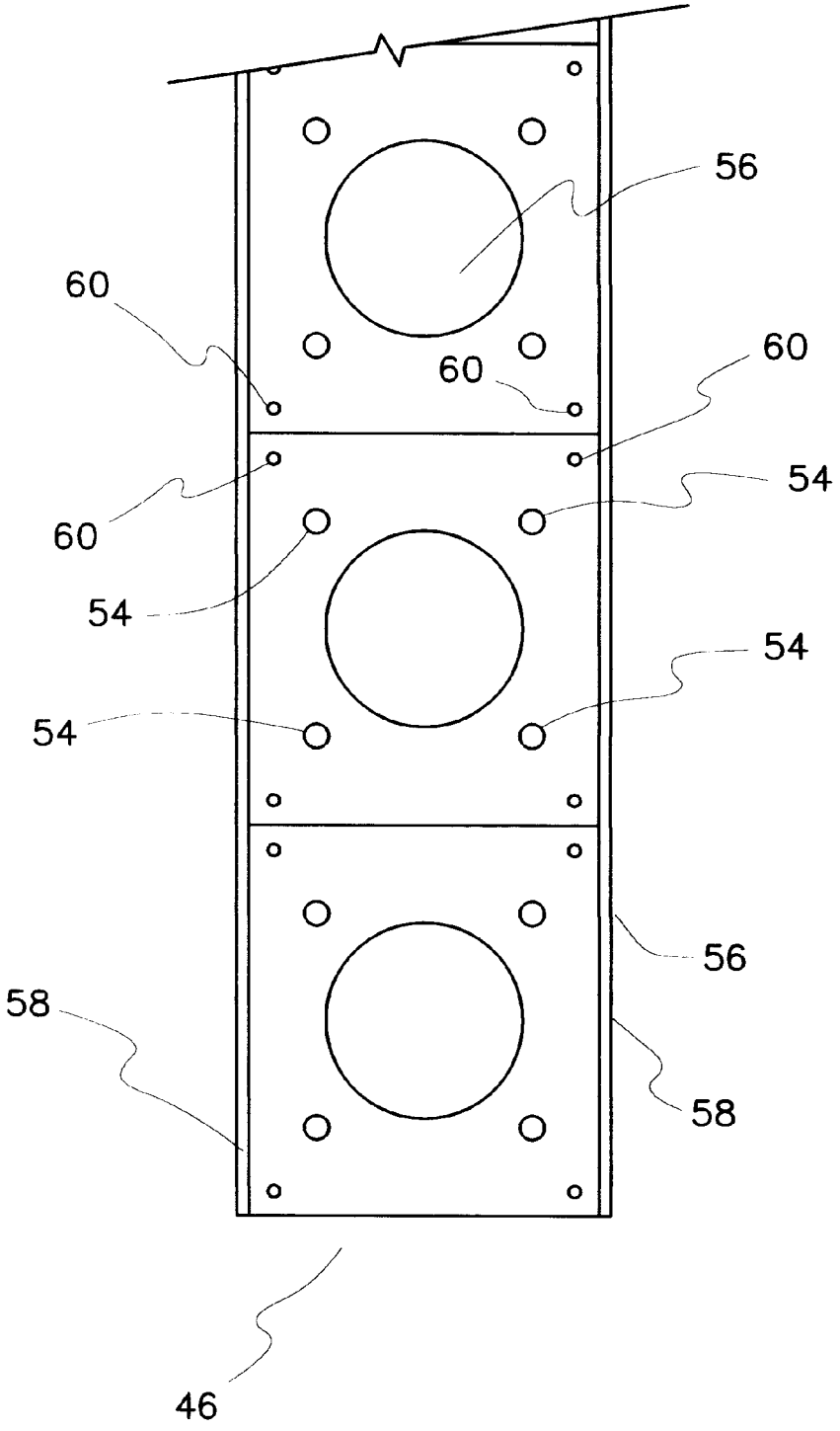
FIG. 6 is a top elevation view of a starter strip in accordance with the present invention.
Figure 7:
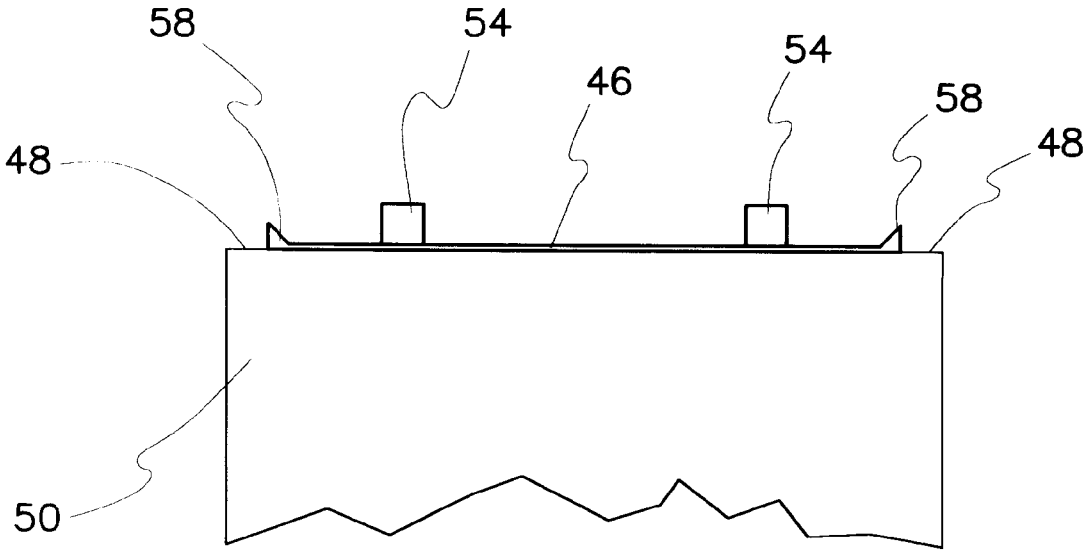
FIG. 7 is an end elevation view of the starter strip depicted in FIG. 6.

Referring to FIGS. 6 and 7, top and side elevation views are depicted of a starter strip 46 in accordance with the present invention. The starter strip 46 is a thin, substantially planar, molded or extruded planar strip of plastic extending longitudinally to any predetermined length, configured and laterally dimensioned to congruently contact and receive the lower planar walls 16 of a plurality of blocks 10. The starter strip 46 is set upon a top wall 48 of a foundation 50 upon which a mortarless wall 12 is constructed. Before receiving the strip 46, the top wall 48 is leveled with a conventional grout material. The starter strip 46 is then positioned upon the top wall to identify the exact placement of the first tier 52 (see FIG. 5) of blocks 10 upon the foundation 50. The strip 46 includes four location pegs 54 positioned at opposing corners of substantially cylindrical openings 56 through the strip 46. The openings 56 are dimensioned substantially equal to corresponding dimensions of the block's 10 square passageways 28. The four location pegs 54 are snugly inserted into the square passageways 28. The starter strip 46 further includes bevel locators 58 positioned at opposing edge portions of the strip 46. The bevel locators 58 have a right isosceles triangle configuration when taking a side view of the strip (see FIG. 7). The bevel locators 58 are positioned to congruently contact, via the hypotenuse portion of the triangular configuration, the beveled longitudinal edges 40 of the inner and outer side walls 18 and 20 adjacent to the lower wall 16 of the block 10. The four locator pegs 54 snugly inserted into each of the two square passageways 28 of a block 10 via the lower wall 16, plus the added alignment feature of the two opposing horizontally extending bevel locators 58, are sufficient to linear align a plurality of blocks 10 forming the first tier 52 of the mortarless wall 12. To secure the starter strip 46 to the top wall 48 of the foundation 50, an orifice 60 is positioned near each location peg 54 to receive a retaining screw or similar fastener.

An alternative to the starter strip 46, is a template having a design identical to the upper wall 114 of the block 10; however, the lugs 26 of the upper wall 14 are placed by recesses with the same configurations and perimeter dimensions as the passageways 28 in the lower wall 16 to snugly receive the lugs 26. The template is placed upon an upper wall 14 of a positioned block 10 such that a portion of the template extends over a gap to be ultimately filled by a block 10. Thus, a portion of the template is supported by the upper wall 14 of a block 10 in an incomplete tier, and the remaining portion of the template positions the next block 10 via the lugs 26 such that the two blocks are lineally aligned with adjacent planar end walls congruently engaged.

Figure 8:
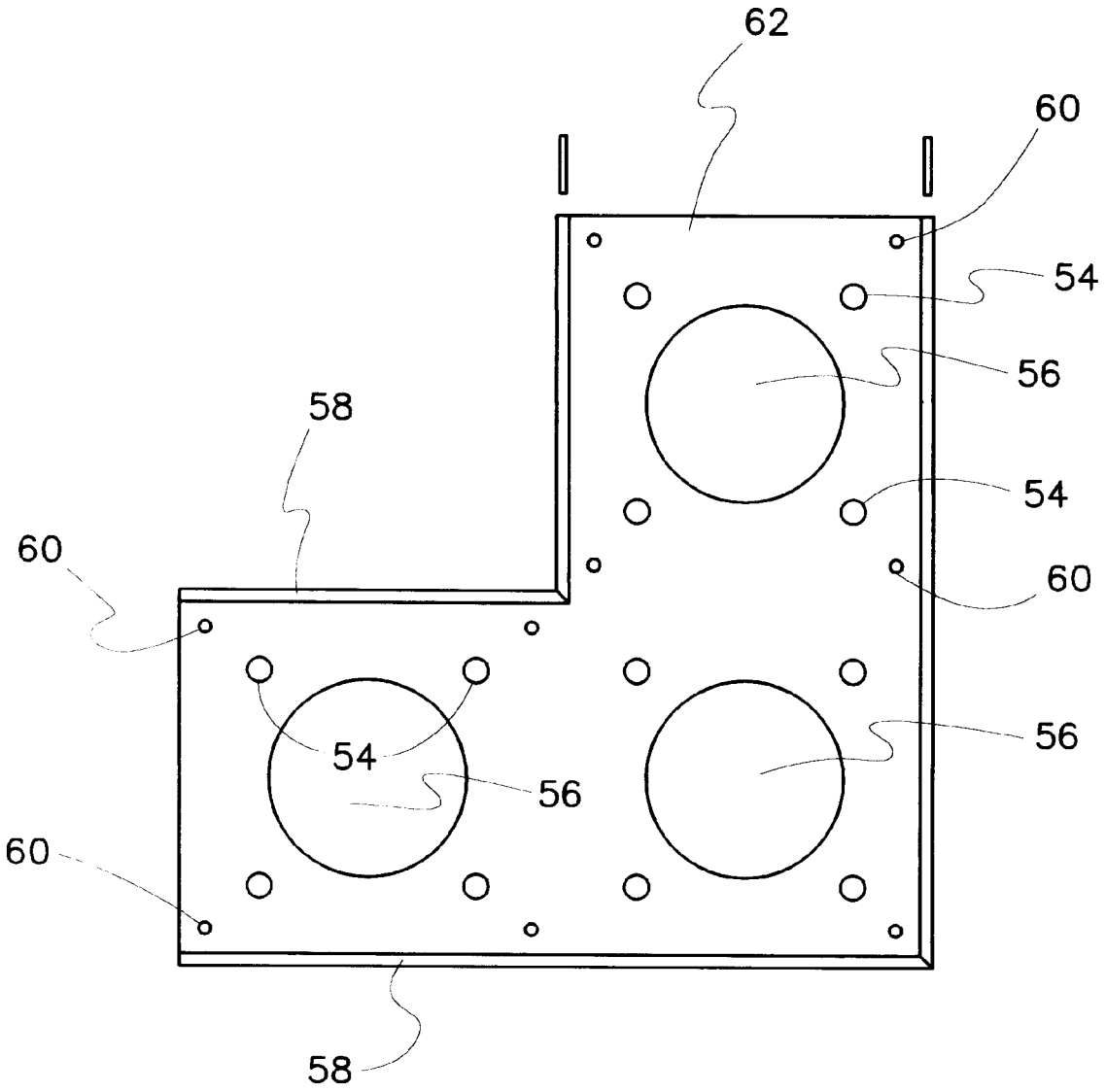
FIG. 8 is a top elevation view of a corner starter section in accordance with the present invention.

Referring to FIG. 8, a top elevation view of a corner starter section in accordance with the present invention, is depicted. The corner section 62 is positioned and then anchored upon a corner portion of the top wall 4 of a leveled foundation 50. The starter strips 46 are positioned adjacent to corner sections 62. The starter strips 46 and sections 62 "lay-out" the first tier 52 of blocks 10 that configure the mortarless walls 12, and provides the base that successive tiers of blocks 10 are set upon to ultimately surround and protect the internal building structure.

Figure 9:
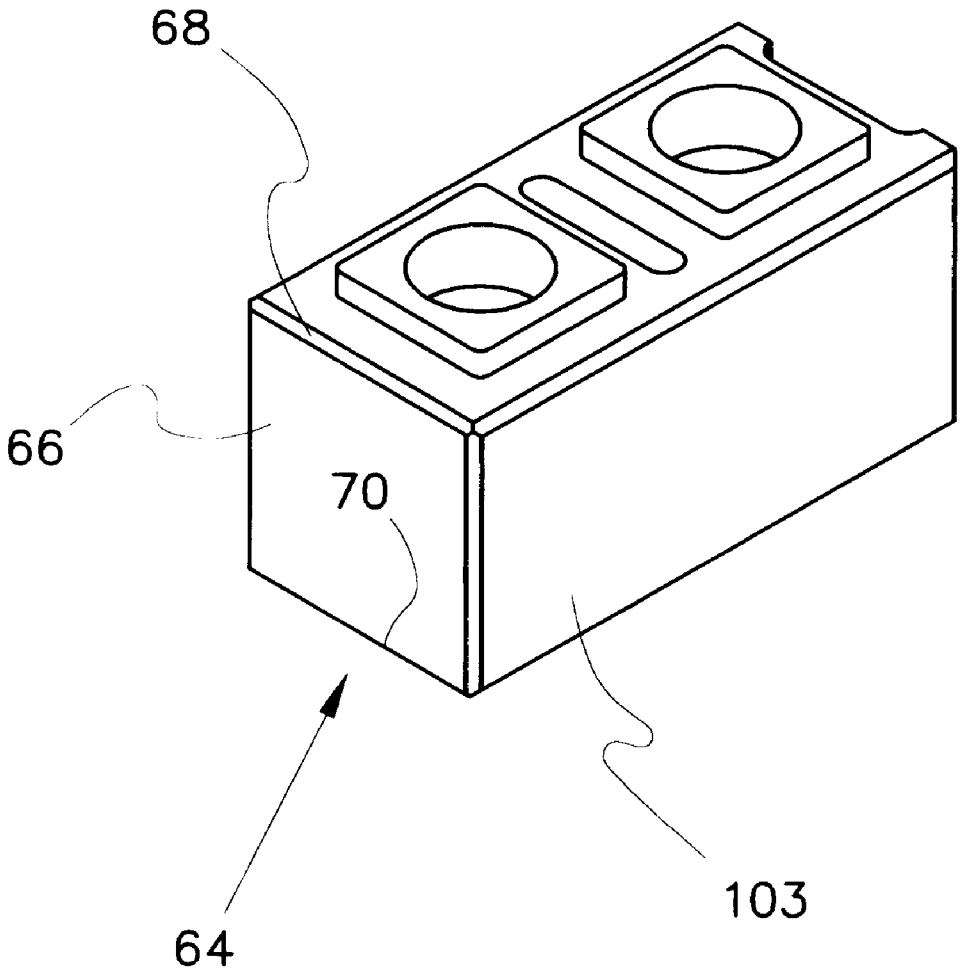
FIG. 9 is a perspective view of a corner block in accordance with the present invention.
Figure 10:
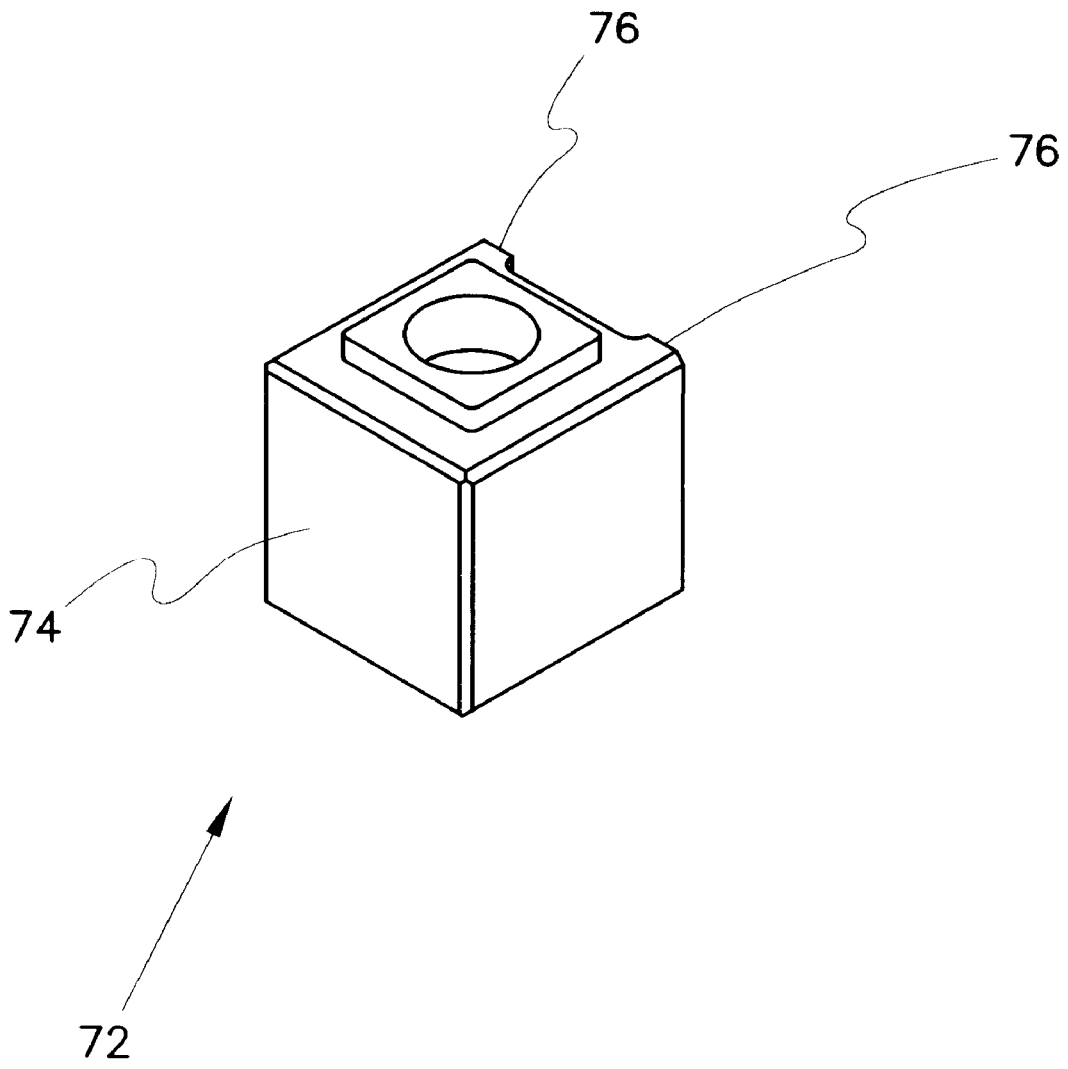
FIG. 10 is a perspective view of a half corner block in accordance with the present invention.
Figure 11:
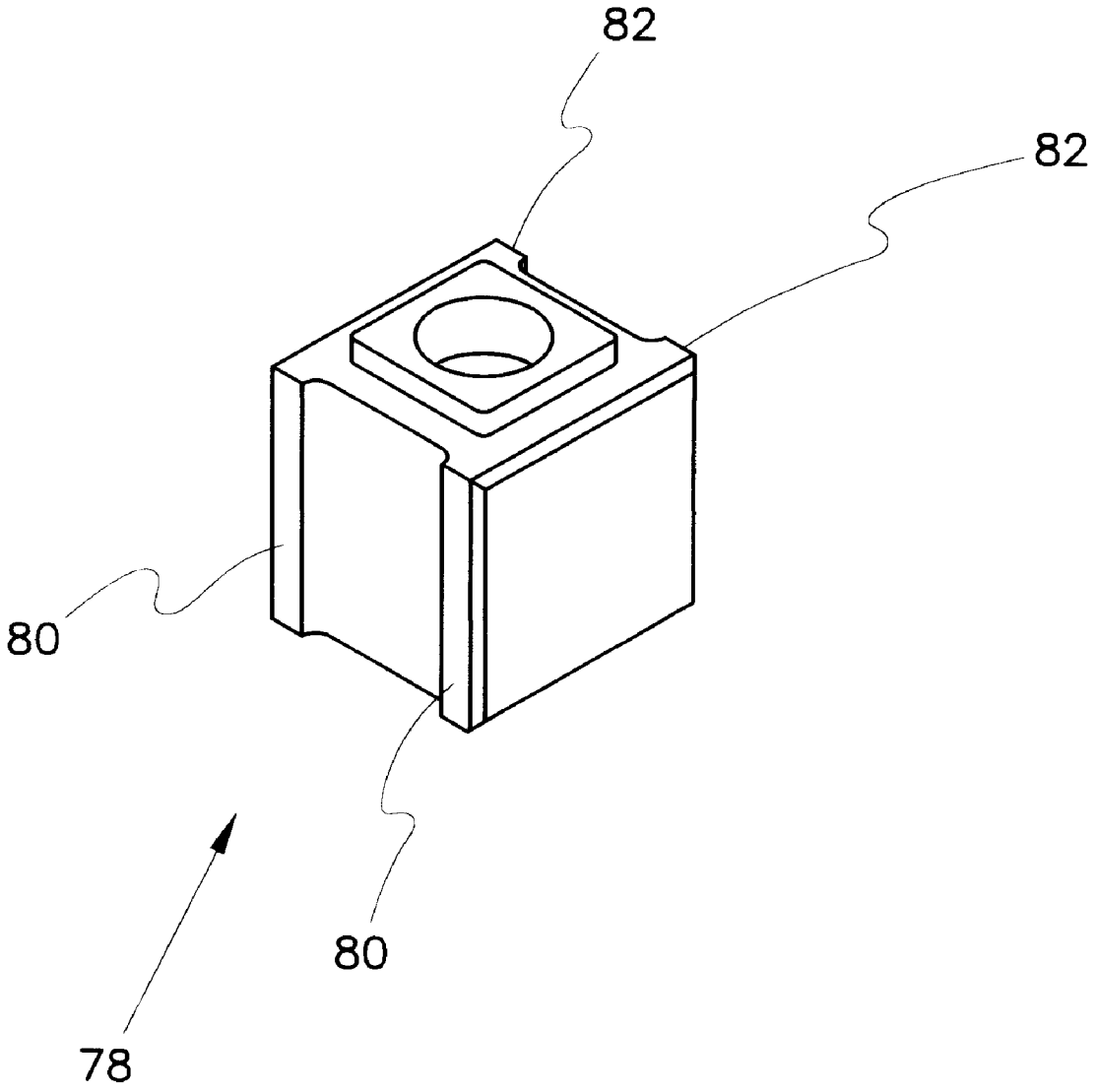
FIG. 11 is a perspective view of a half block in accordance with the present invention.
Figure 12:
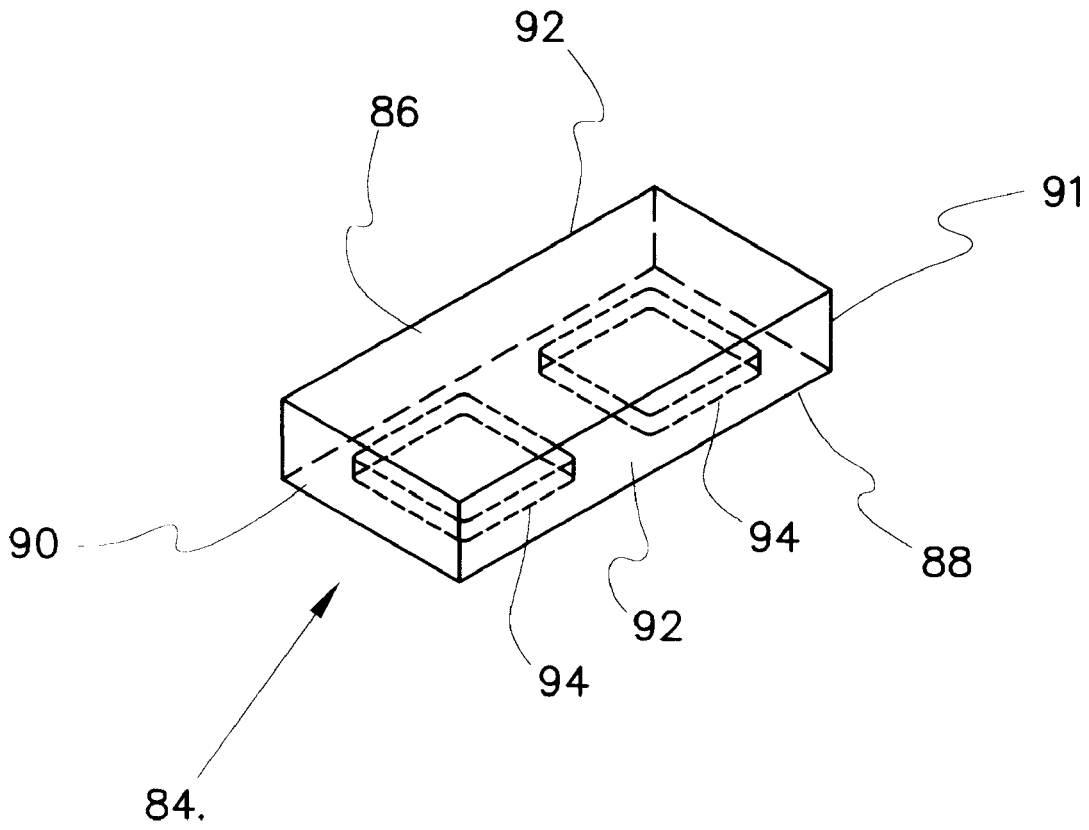
FIG. 12 is a perspective view of a cap block in accordance with the present invention.

Referring to FIGS. 9, 10, 11 and 12, perspective views of design variations of the block 10 depicted in FIG. 1, are illustrated in accordance with the present invention. The different designs of a basic building block or a brick, are required to construct any wall. FIG. 9 depicts a corner block 64. The corner block 64 is identical to the building block 10 detailed above, in all respects except that the corner block 64 has a planar first end 66 with beveled upper and lower edges 68 and 70. FIG. 10 depicts a half corner block 72. The half corner block 72 is identical to the corner block 64 of FIG. 9 in all respects except that the half corner block 72 has only one passageway 28, and measurers eight inches between first and second end walls 74 and 76 as compared to a corresponding sixteen inch dimensions for the corner block 64. FIG. 11 depicts a half block 78. The half block 78 is identical to the building block 10 detailed above, in all respects except that the half block has only one passageway 28, and measures eight inches between first and second end walls 80 and 82 as compound to a corresponding sixteen inch dimension between first and second end walls 22 and 24 of the building block 10. FIG. 12 depicts a cap block 84. The cap block 84 completes the construction of the mortarless wall 12 by covering the top tier of building blocks 10. The cap block 84 has the same dimensions as the building block 10 including the two passageways 28 except that the distance between the upper and lower planar walls 86 and 88 is only half (four inches) the corresponding distance between the upper and lower walls 14 and 16 of the building block 10. The cap block is comprised of solid, planar end walls 90 and 91, side walls 92 and upper wall 86. The longitudinal edges formed by the upper wall 86 and side walls 92 are not beveled. The lateral edges formed by the upper wall 86 and end walls 90 and 91 are beveled. The lower wall 88 has two recesses 94 therein that are configured to congruently align with the two square passageways 28 of the top tier of building blocks 10 thereby securing the cap blocks 84 upon the blocks 10 and providing a finishing tier of blocks with no opening but instead solid planar walls.

Figure 13:
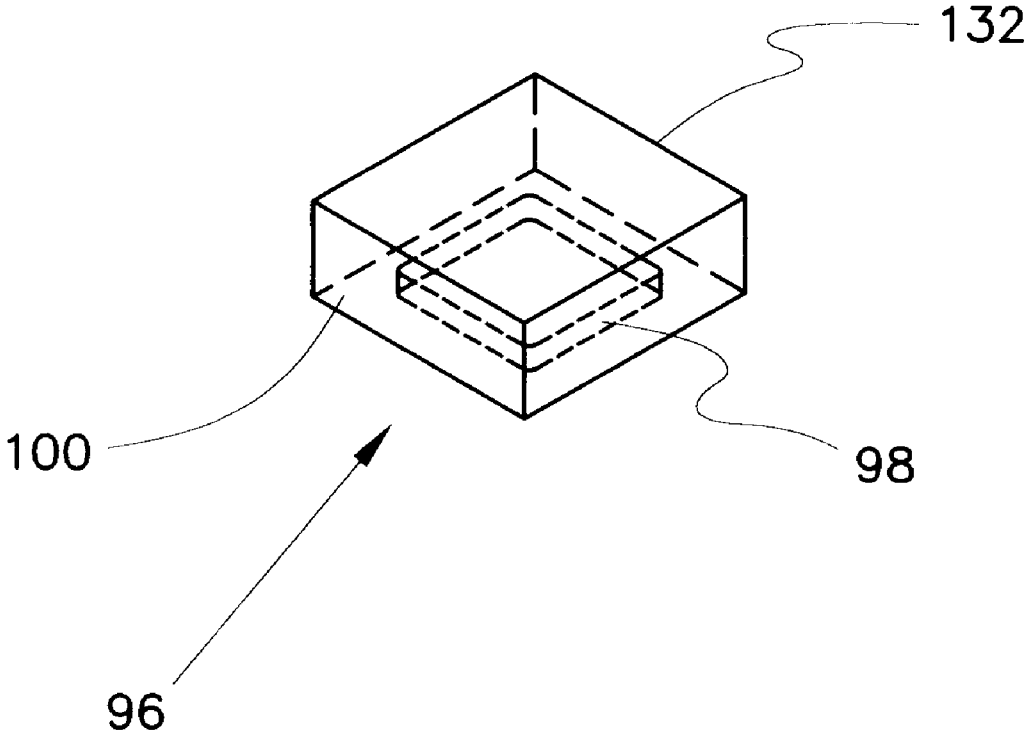
FIG. 13 is a perspective view of a half cap block in accordance with the present invention.

A half cap block 96 (see FIG. 13) is identical to the cap block 84 in all respects except that the half cap block 96 has one recess 98, and measures eight inches between first and second end walls 100 and 102 as compared to a corresponding sixteen inch dimension between first and second end walls 90 and 91 of the cap block 84.

In operation, a building foundation 50 is constructed to dimensionally correspond to the required bricks or building block 10 selected to build a mortarless wall 12. When constructing a mortarless wall, it is critical to have the top wall 48 of the foundation 50 level and planar. Unlike a conventional wall built with building blocks and mortar, the mortarless wall 12 has no error compensation means to correct level and alignment errors. The top wall 48 is planed and leveled by spreading a grout material over the surface of the top wall 48 that the building blocks 10 are ultimately set upon; however, should the top wall 48 be sufficiently smooth and level, the grouting step may be deleted and a starter strip 46 positioned directly upon the top wall 48 of the foundation 50. Should grouting be required, the starter strip 46 is then secured to the grouted top wall 48. Should corners be encountered, a starter corner section 62 is utilized. The starter strip 46 and corner section 62 maintain the blocks 10 used to lay-out the first tier 52 of blocks 10 linear and square. As detailed above, a mortarless wall has no error compensation means. Therefore, the assembled blocks must be kept not only level, but also straight and square from the start. It is critical that a mortarless wall 12 have the first tier 52 of blocks 10 level, linear and square. If the first tier 52 does not conform to these requirements, a successive tier of blocks will not be capable of receiving extension lugs 26 from two adjacent blocks 10 in the first tier 52.

The starter strips 46 and corner sections 62 are fastened to grouted top wall 48 of the foundation 50. A first tier 52 of blocks 10 is then positioned upon respective starter strips 46 and corner sections 62 such that adjacent lineal blocks 10 have respective adjacent first and second end walls 22 and 24 in congruent physical contact. Should a corner be encountered (see FIG. 5), one corner block 64 has a planar first end 66 in congruent physical contact with a planar first half side portion 103 of a second corner block 64.

The entire first tier 52 of blocks is positioned pursuant to the process detailed above plus the inclusion of half corner blocks 72 and half blocks 78. Upon completing the first tier 52, successive tiers of building blocks 10 are set one upon another in a staggered configuration. More specifically, a first half portion 104 of a lower wall 16 of a block 10 is set upon a second half portion 106 of an upper wall 14 of a block 10 in the first tier 52 (see FIG. 5), and a second half portion 108 of the lower wall 16 is set upon a first half portion 110 of an upper wall 14 of an adjacent block 10 in the first tier 52. The above detailed method is continued until the required building block elevation is achieved. The mortarless wall 12 is completed by utilizing cap blocks 84 and 96 to cover the top tier of building blocks 10 while maintaining the same staggered configuration as detailed above.

Figure 14:
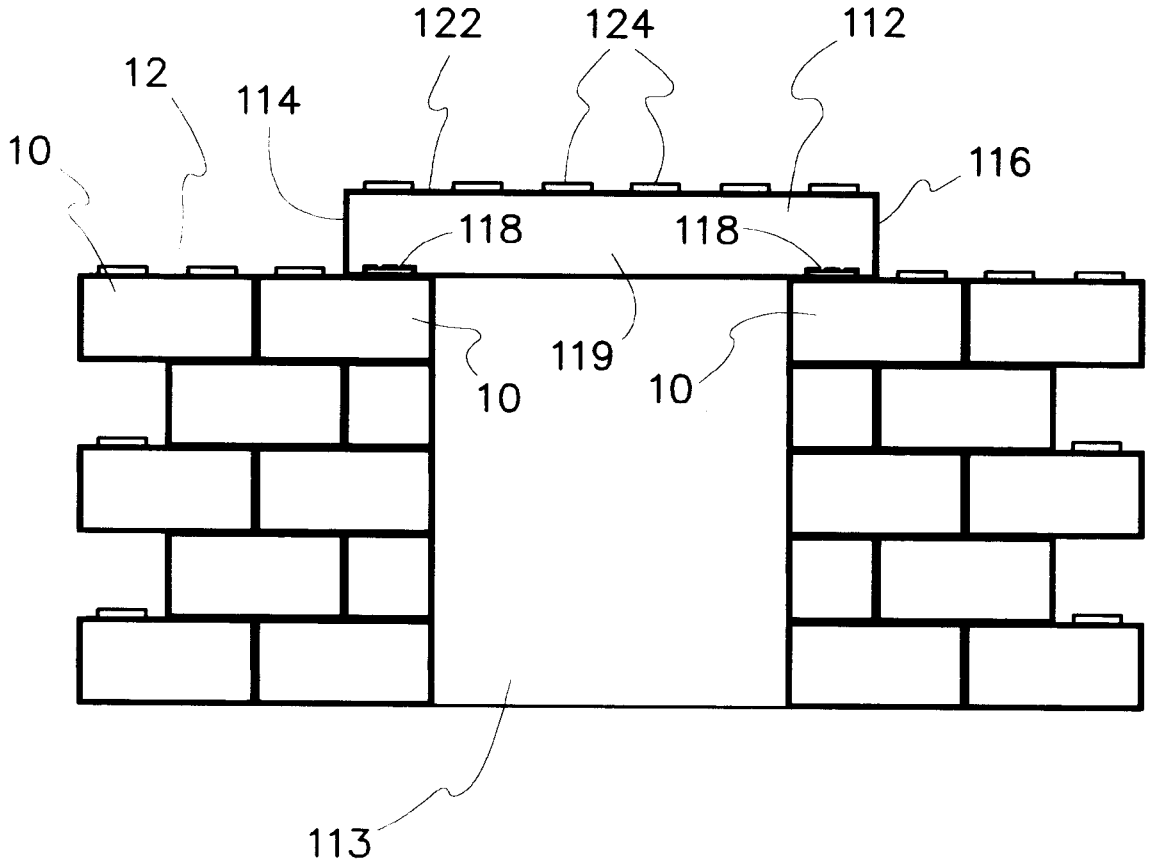
FIG. 14 is a front elevation view of a lintel spanning an opening in accordance with the present invention.

Referring to FIG. 14, a lintel 112 or horizontal member is depicted spanning and carrying the load above an opening 113 in accordance with the present invention. The lintel 112 is a building block 10 having a dimension between end walls 114 and 116 that corresponds to the horizontal dimension of the opening 113 that the lintel 112 spans. Further, the lintel 12 has only two recesses 118 in a planar lower wall 119, and are configured to snugly receive the lugs from adjacent blocks 10 in the lower tier. The lintel has an upper planar wall 122 with multiple lugs 124 extending therefrom to snugly insert into the recess of adjacent blocks 10 in the upper tier. The quantity of lugs 124 are dimensioned and positioned to correspond to the quantity, dimensions and positions of the recesses in the adjacent blocks 10 in the upper tier. Should the lintel 112 become a cap block, the lintel would have the same dimension between the upper and lower walls 122 and 119 as described above, and the upper wall 122 would be horizontally planar with no lugs 124 extending therefrom.

Figure 15:
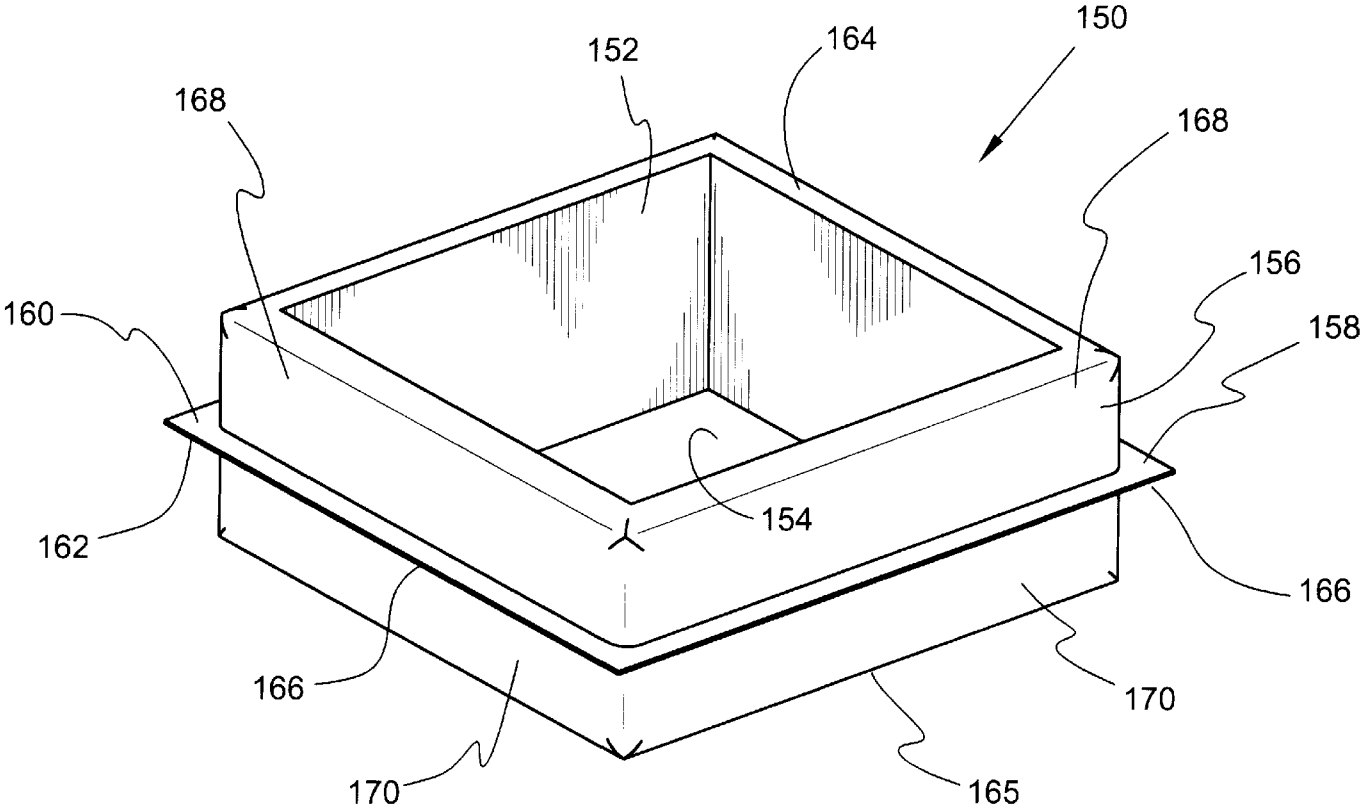
FIG. 15 is a perspective view of a locator plug for insertion into a building block for constructing a mortarless wall in accordance with the present invention.
Figure 16:
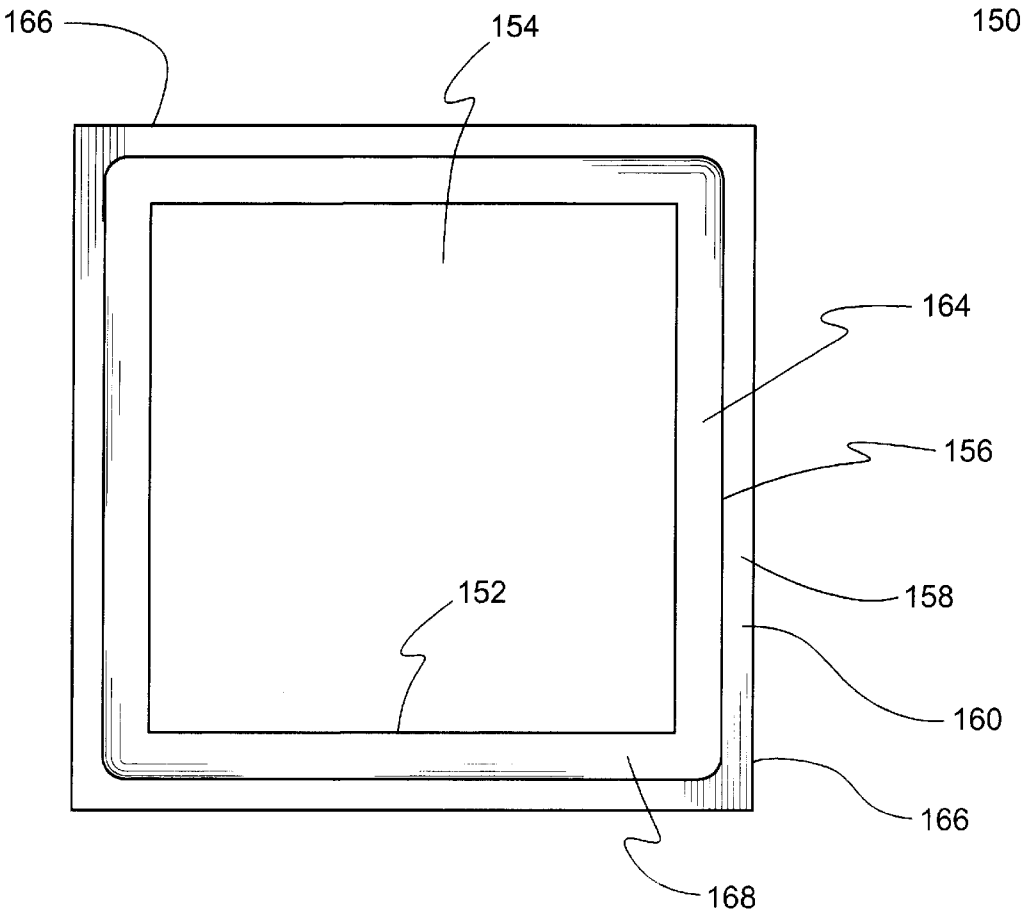
FIG. 16 is a top elevation view of the locator plug depicted in FIG. 15.
Figure 17:
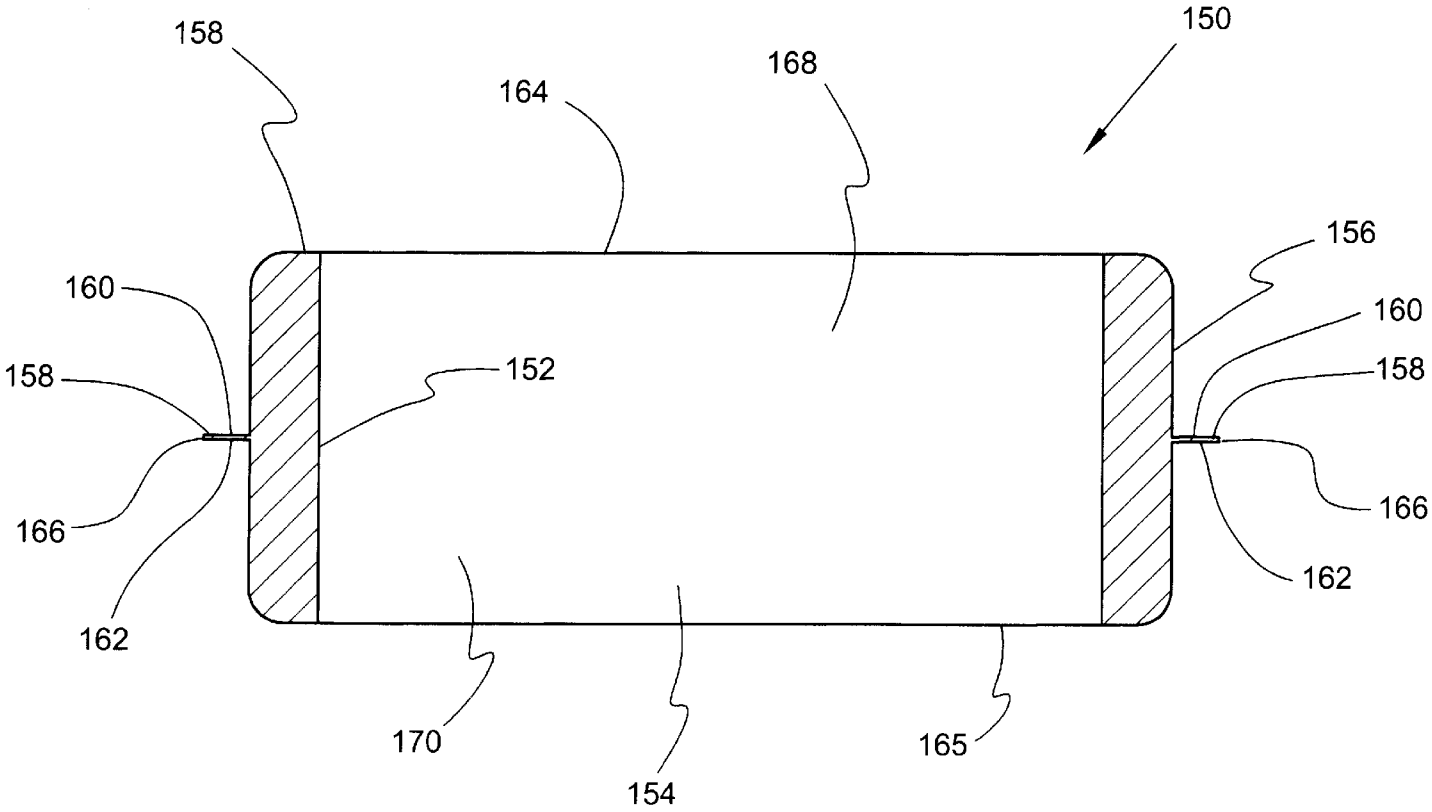
FIG. 17 is a side elevation view of the locator plug depicted in FIG. 15.

Referring now to FIGS. 15–17, a perspective, top and side elevation view of an alternative embodiment for constructing a mortarless wall, are depicted. The figures illustrate an interlocking member or locator plug 150 having a substantially square configuration, when taking a top view, that ultimately inserts into the recess or passageways 28 (see FIG. 4) of the blocks 10 thereby replacing the lugs 26 used to align and stabilize adjacent tiers of blocks 10. The locator plug 150 may be fabricated from a myriad of materials such as plastic, metal and concrete; however, the material of choice is plastic. The substantially square configuration of the locator plug 150 is formed from an inner wall 152 that establishes the relative size of an aperture 154 through the locator plug 150, and an outer wall 156 that establishes the relative perimeter of the plug 150 so that the plug 150 is capable of inserting into the passageways 28 (FIG. 4) of the block 10. The outer wall 156 includes a flange 158 integrally joined to a mid portion of the outer wall 156 such that upper and lower walls 160 and 162 of the flange 158 are perpendicular to the outer wall 156 of the locator plug 150, and parallel to top and bottom walls 164 and 165 of the locator plug 150. The flange 158 has a lateral dimension sufficient to position an edge portion 166 of the flange in physical contact with respective upper and lower planar walls 14 and 16 (FIG. 4) of the blocks 10 when the plug 150 is inserted into the passageway 28 of the block 10 thereby maintaining the position of the locator plug in the passageway 28 (FIG. 4) of a lower tiered block 10, and ultimately inserting into the passageway 28 of an upper tiered block 10 thus positioning and securing adjacent upper and lower tiered blocks 10.

The locator plug 150 is removably received by the passageways 28 of specially sized blocks 10 utilized to build a mortarless, or the passageways of conventionally sized blocks used to construct a wall with mortar. In either case, the "thickness" of the plug 150 or the distance separating the top and bottom walls 164 and 165 of the plug 150 may vary depending on the relative stability required by the type of block being used to construct the wall. However, empirical studies reveal that a distance of separation of two inches of the walls 164 and 165 with at least one inch of extension of upper and lower portions 168 and 170 of the plug 150 into adjacent passageway 28 above and below the flange 158, is sufficient to provide the required stability for the construction of a mortarless wall or a conventional wall with mortar.

The distance separating the upper and lower walls 160 and 162 of the flange 158 is extremely small and set at a dimension to provide sufficient strength to maintain the position of the plug once inserted into a passageway 28, and to avoid misaligning the blocks 10 due to the flange 158 being inserted between perimeter portions of passageways 28 of adjacent blocks 10 in upper and lower tiers of the wall.

In operation, the locator plugs 150 replace the lugs 26 that were integrally joined to the blocks 10. The lugs 26 were a very expensive and time consuming method of stabilizing a block wall. Also, the lugs 26 substantially increased the weight of each block, causing the cost of labor to assemble the blocks to drastically increase. Conversely, the light weight plastic removable locator plugs 150 provide a faster, less expensive and equally stable method of constructing a mortarless wall made from blocks, bricks, or other wall constructing members.

Figure 18:
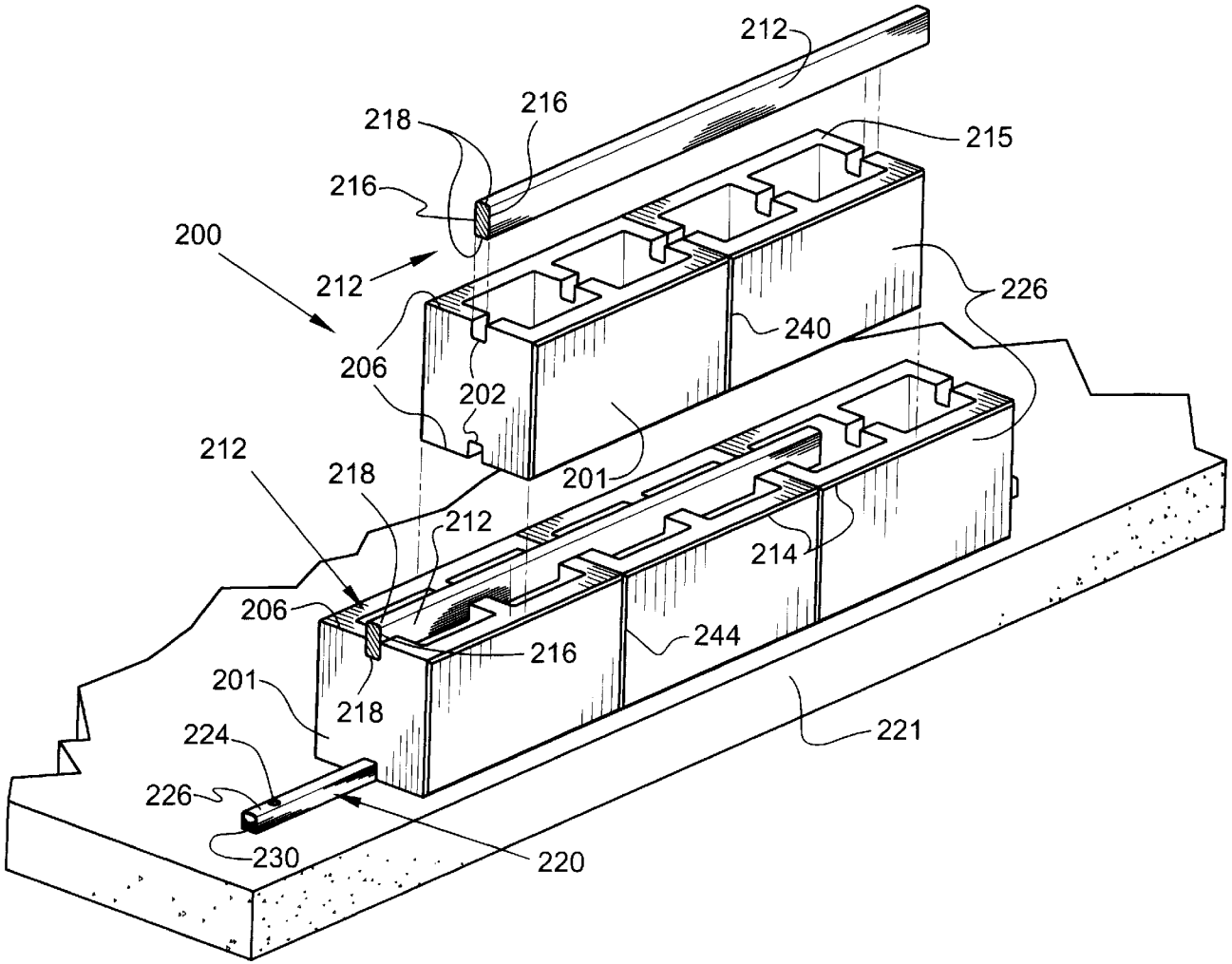
FIG. 18 is a perspective view of a mortarless wall constructed from an alternative method in accordance with the present invention.
Figure 19:
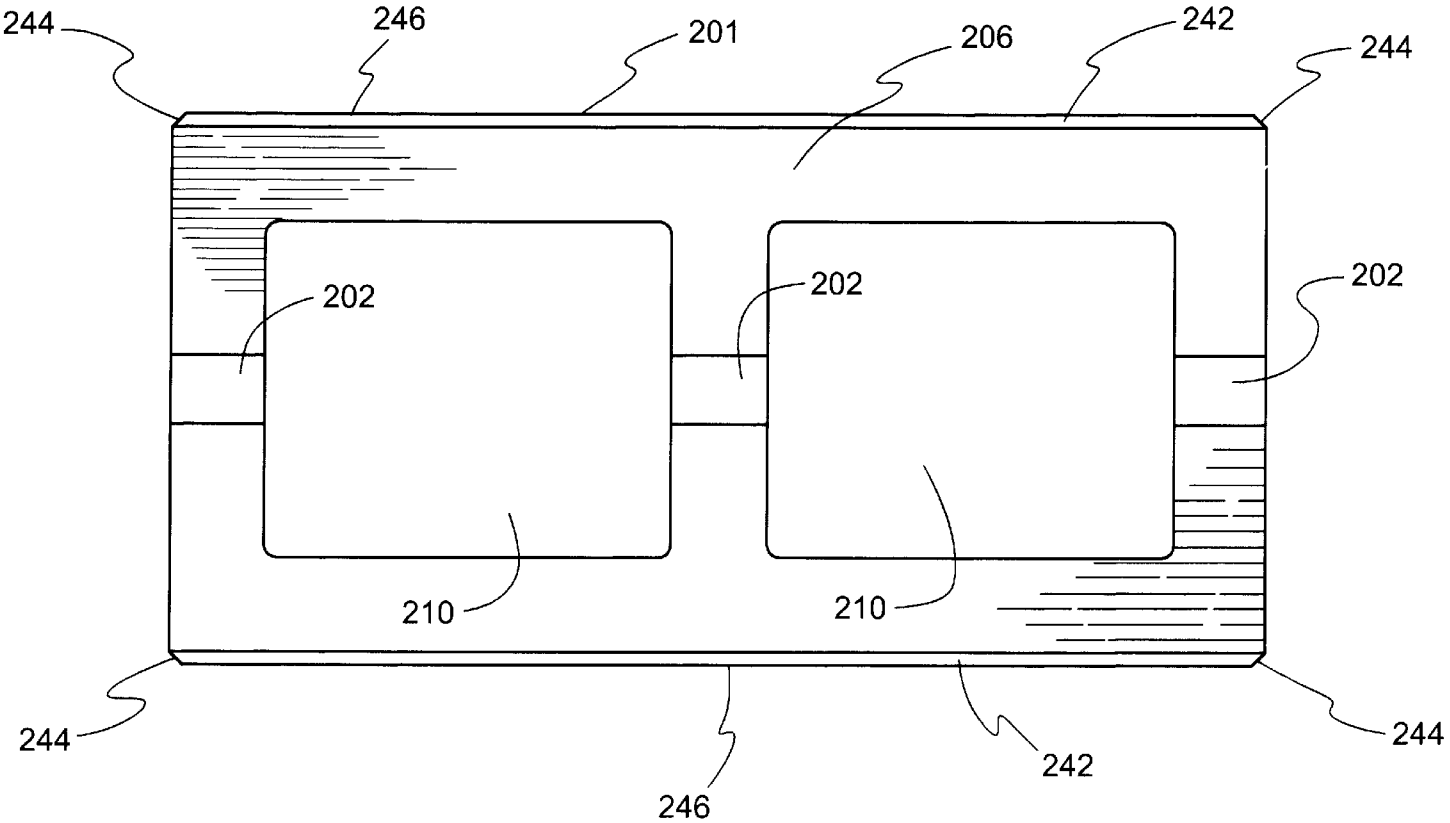
FIG. 19 is a top elevation view of a block forming the mortarless wall depicted in FIG. 18.
Figure 20:
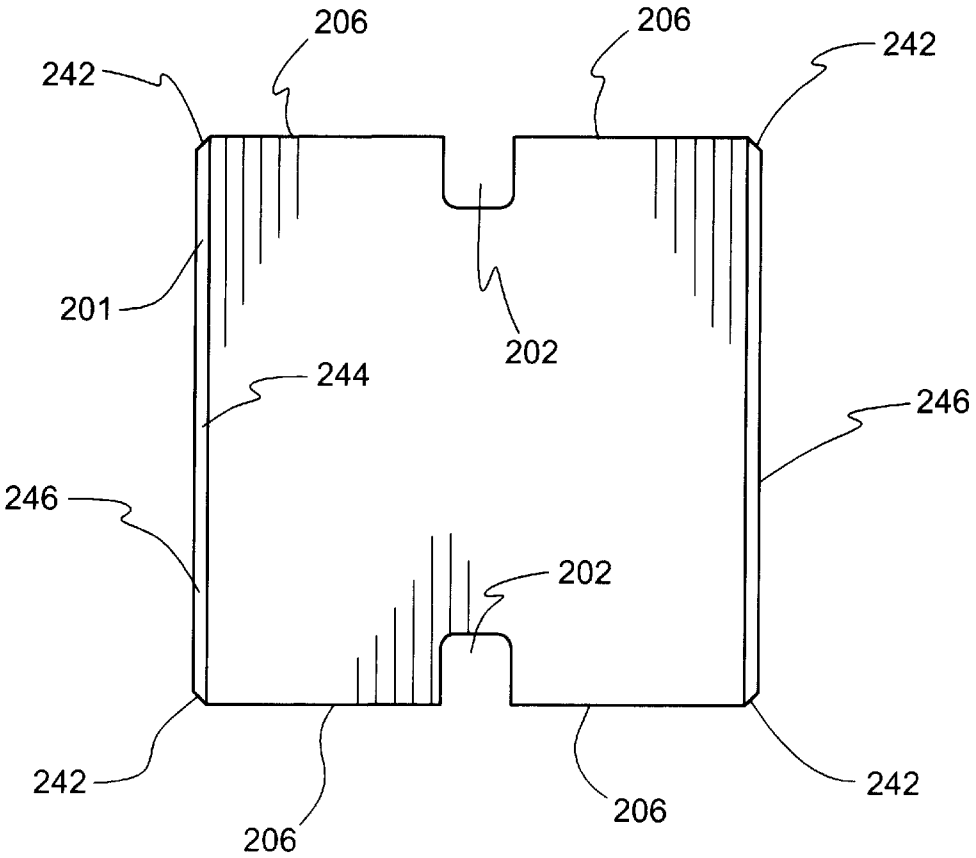
FIG. 20 is an end elevation view of the block forming the mortarless wall depicted in FIG. 18.

Referring now to FIGS. 18–20, a perspective (FIG. 8), top and/or bottom elevation view (FIG. 19), and an end elevation view (FIG. 20) of another alternative method for constructing a mortarless wall 200, are depicted. The figures illustrate a wall 200 (FIG. 18) fabricated from blocks 201 (FIGS. 19 and 20) having a modified design that includes upper and lower recesses 202 positioned along a longitudinal center line in planar, upper and lower walls 206 to integrally join with two passageways 210 such that upper and lower longitudinal channels or recesses are formed that receive alignment rails 212 therein that extend across entire tiers 214 and 215 of aligned blocks 201. The alignment rails 212 are fabricated from rigid, non-deformable, tubular plastic channel having substantial tensile and compression resistant strength thereby providing an alignment and stabilizing member for constructing the mortarless wall 200 to any height that a wall utilizing mortar is capable of attaining.

The recesses 202 have a substantially square configuration when taking end, top and bottom elevation view of the block 201. The alignment rails 212 have a substantially rectangular configuration, when taking an end view, such that longitudinal edges 216 are approximately twice as long as the lateral edges 218. The lateral edges 218 are sized to allow the alignment rails 212 to snugly insert into the recesses 202 when the lateral edges 218 are positioned parallel to the planar walls 206 of the block 201, and the alignment rail 212 is positioned parallel to and in alignment with the longitudinal centerline of the planar walls 206. The longitudinal edges 216 are sized to allow the alignment rails 212 to congruently engage adjacently positioned recesses 202 in upper and lower walls 206 in adjacent tiers of blocks 201. Emperical studies reveal that an alignment rail 202 having a longitudinal dimension of two inches, when inserted into two adjacently positioned one inch square recesses 202, is sufficient to provide the required stability and aligning capability to assemble a mortarless wall.

Figure 21:
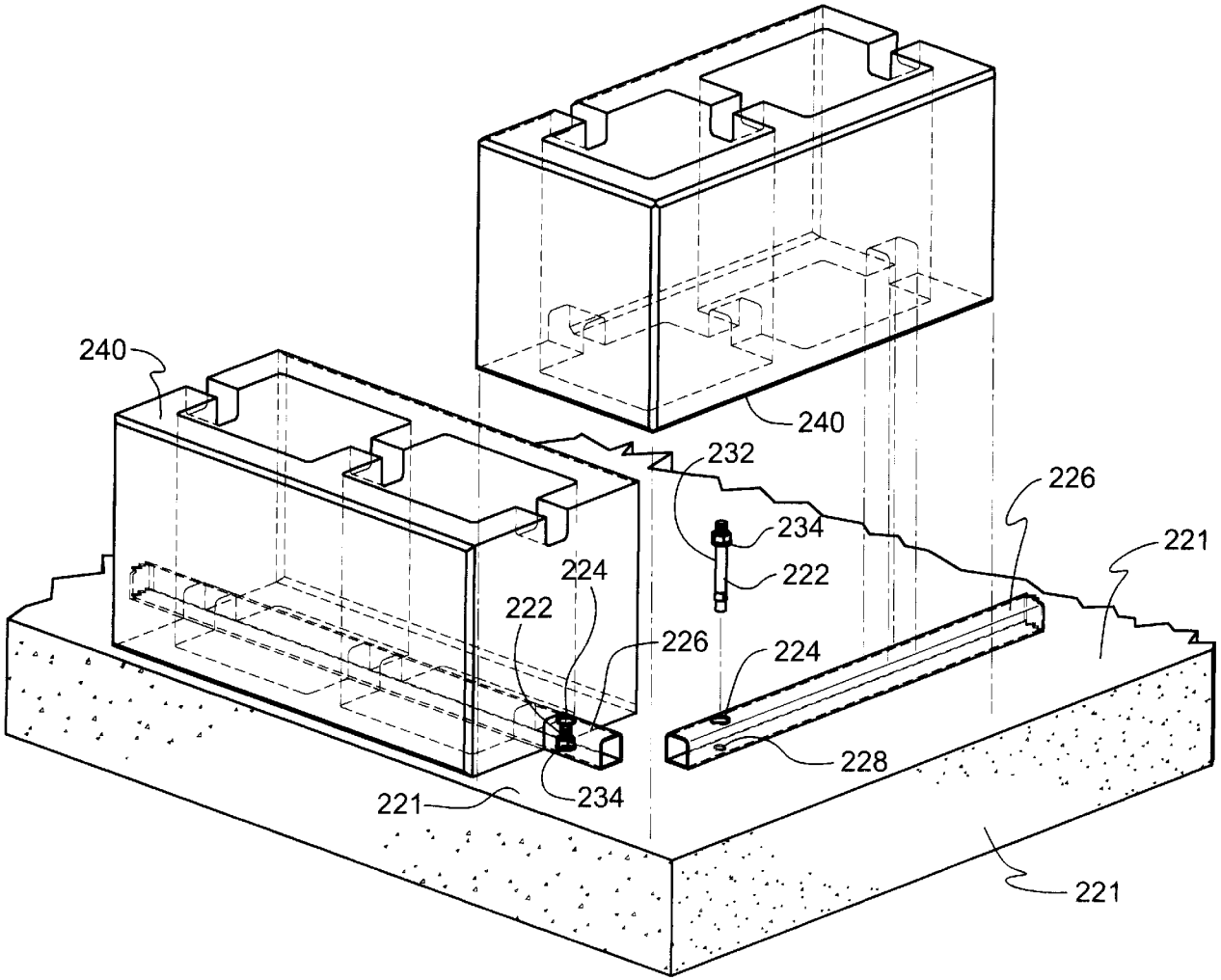
FIG. 21 is a perspective, phantom view depicting the method of attaching a starter rail to a footer with a corner in accordance with the present invention

The alternative mortarless wall 200 further includes a plastic starter rail 220 bolted to a concrete slab or footer 221 via wedge lock concrete anchor studs 222 (see FIG. 21) spaced approximately two feet apart along the longitudinal centerline of the starter rail 220. The studs 222 are inserted through relatively large apertures 224 in a top wall 226 of the starter rail 220, and into a relatively smaller aperture 228 in the bottom wall 230 of the starter rail 220. The starter rail 220 has a substantially square configuration, when taking an end elevation view, and further dimensioned to snugly and congruently insert into the recess 202 in the lower planar wall 206 at the blocks 201 contacting the footer 221, and sized to position the outer side 231 of the bottom wall 230 of the starter rail 220 flush against the footer 221. The large aperture 224 in the top wall 226 is configured to allow the anchor studs 222 to pass completely through the top wall 226. The small aperture 228 is sized to allow only a lower portion 232 of the anchor stud 222 to pass through, and to provide engagement between the bottom wall 230 and an upper portion 234 of the anchor stud 222 thereby allowing the anchor stud 222 to avoid misaligning the blocks 201 while securing the starter rail 220 to the footer 221 via the bottom wall 230.

Figure 22:
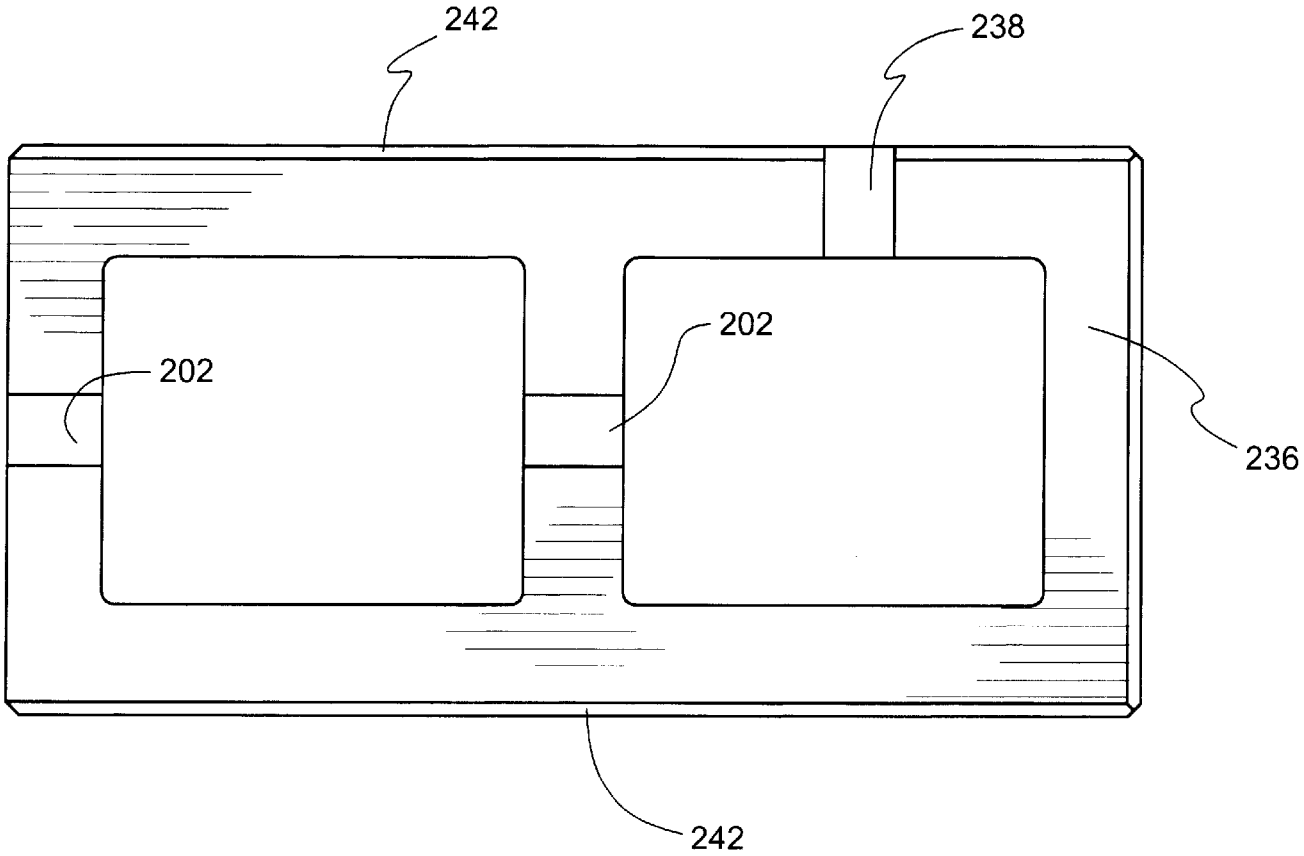
FIG. 22 is a top elevation view of a corner block forming the corner for the mortarless wall depicted in FIG. 21.

In operation, a mortarless wall 200 is constructed from blocks 201 engaging leveled and aligned starter rails 220 secured to a leveled footer or concrete slab 221. The starter rails 220 are longitudinally aligned end to end until the entire perimeter of a concrete slab or footer 221 has a starter rail 220 attached thereto via anchor studs 222 driven into the footer 221. A first tier of blocks 214 is leveled upon the footing 221, positioned end to end, and aligned via the starter rail 220 along the entire perimeter of the footer 221. Corner sections of the starter rail 220 require a corner block 236 (FIG. 22) having an angle recess 238 that receives the starter rail 220 that forms the ninety degree corner. The corner block 236 includes two typical center aligned recesses 202 to receive the other starter rail 220 forming the ninety degree corner.

Upon completing the first tier 214 of blocks 201, an alignment rail 212 is snugly inserted into the recesses of the upper planar walls 206 of the blocks 201 until the entire perimeter of the upper planar walls 206 of the first tier 214 of blocks 201 has an alignment rail 212 secured thereto. A second tier 215 of blocks 201 is then positioned upon the first tier 214 such that the recesses of the lower planar walls of the blocks 201, snugly receive the alignment rail 212 therein, thereby positioning and stabilizing the second tier 215 of blocks 201 upon the first tier 214. The method of assembly continues until the entire mortarless wall 200 is assembled, resulting in tiers of blocks 201 being secured and stabilized along both top and bottom walls 206 via the recesses 202. The construction of the mortarless wall is complete when outer vertical and horizontal edges formed in the mortarless wall 200, are sealed with a caulking compound to seal gaps between the block 201 and to prevent moisture from seeping between adjacently positioned blocks 201. The compound is inserted into V-shaped recesses or grooves 240 around the perimeter of each block 201 forming the wall 200. The V-shaped recesses 240 being configured from beveled longitudinal and lateral edges 242 and 244 on the side walls 246 of the blocks 201.

The foregoing description has detailed a mortarless wall construction using starter and alignment rails 220 and 212 inserted in recesses 202 in upper and lower planar block walls 206. However, the above method may be utilized to construct a convention block wall using mortar and standard dimensioned blocks. The mortar would be positioned between adjacent upper and lower planar walls 206 engaging the alignment and starter rails 212 and 220, and adjacent end walls 248 (FIGS. 19 and 20) of adjacent blocks 201. Utilizing mortar, deletes beveled lateral and longitudinal side wall edges and the moisture resistant sealant. However, the mortar would separate blocks in adjacent tiers thereby introducing a gap between the top portion of an alignment rail 212 in a lower tiered block, and the top portion of the recesses in the bottom wall 206 of an upper tiered block. The gap would reduce the stabilizing feature of the alignment and starter rails 212 and 220, but would not effect the alignment benefits of the rails 212 and 220.

The foregoing description is for purposes of illustration only and is not intended to limit the scope of protection accorded this invention. The scope of protection is to be measured by the following claims, which should be interpreted as broadly as the inventive construction permits.

What is claimed is:

1. A mortarless wall comprising:

a plurality of building blocks configured into horizontally extending tiers of blocks resting one upon another, the block of each tier being in staggered relation to blocks of adjacent upper and lower tiers of blocks, said blocks having a side wall with beveled longitudinal and lateral edges that form recesses between adjacent blocks, said recesses receiving a sealant that prevents moisture from entering gaps between adjacently positioned blocks, said sealant in said recesses thereby allowing a mortarless wall construction that includes the lower walls of upper blocks physically contacting the upper walls of adjacent lower blocks, and further allowing physical contact between end walls of adjacent blocks in the same tier;

means for leveling a top wall of a foundation upon which a first tier of said blocks is positioned;

a starter rail continuously extending upon said leveling means; and an alignment rail continuously extending between adjacent tiers of blocks, said alignment rail being inserted in recesses in said upper and lower walls of said blocks said upper and lower recesses positioned along a longitudinal center line in planar upper and lower walls thereby allowing physical contact between said lower walls of said upper blocks and said upper walls of said lower blocks.

2. The mortarless wall of claim 1 wherein said leveling means includes a grout material placed upon said top wall.

3. The mortarless wall of claim 1 wherein said horizontally aligning means for said first tier of blocks includes a starter strip.

4. The mortarless wall of claim 1 wherein said horizontally aligning means for said first tier of blocks includes a template alignment tool.

5. The mortarless wall of claim 1 wherein said recesses in said upper and lower walls of said blocks, are positioned such that an alignment rail inserted in said recesses is positioned parallel to and in alignment with the longitudinal center line of said upper and lower walls.

6. A block wall constructed without mortar comprising:

a plurality of building blocks configured into horizontally extending tiers of blocks resting one upon another, the blocks of each tier being in staggered relation to blocks of adjacent upper and lower tiers of blocks, said blocks having upper and lower walls with longitudinal recesses therein said upper and lower recesses positioned along a longitudinal center line in planar upper and lower walls that removably receive rails that protrude from said recesses a distance sufficient to insert into adjacent longitudinal recesses in upper and lower walls of respective lower and upper tiers of blocks;

means for leveling a footer upon which a first tier of said blocks is positioned;

a starter rail continuously extending upon said leveling means;

an alignment rail continuously extending between adjacent tiers of blocks, said alignment rail being inserted in recesses in said upper and lower walls of said blocks thereby allowing physical contact between said lower walls of said upper blocks and said upper walls of said lower blocks;

means for securing said starter rail to said footer; and means for sealing longitudinal and lateral edges of outer side walls of said blocks to prevent moisture from seeping between adjacently positioned blocks.

7. The mortarless wall of claim 6 wherein said securing means includes a tubular channel having apertures in top and bottom walls to receive an anchor stud therethrough such that an upper portion of said anchor stud engages said bottom wall of said channel, and a lower portion of said anchor stud is anchored into said footer.

8. The mortarless wall of claim 6 wherein said recesses are positioned along a longitudinal centerline in said upper and lower walls of said blocks.

9. A method of aligning and stabilizing blocks forming a wall comprising the steps of:

leveling a footer receiving a plurality of blocks thereupon;

attaching a starter rail continuously extending upon a perimeter portion of said footer;

providing a plurality of blocks having longitudinal recesses in upper and lower planar walls;

positioning a plurality of said blocks upon said footer such that said recesses in said lower walls snugly receive said starter rail, and said lower walls of said blocks engage said footer thereby forming a first tier of blocks upon said perimeter portion of said footer;

inserting an alignment rail snugly into said recesses in said upper wall of said blocks in said first tier, said alignment rail continuously extending upon said first tier of blocks such that the entire perimeter of said upper walls of said first tier of blocks has an alignment rail secured thereto:

positioning a plurality of said blocks upon said first tier of blocks such that said recesses in said lower walls snugly receive said alignment rail, and said lower walls of said blocks engage said upper walls of said blocks in said first tier in a staggered relation thereby forming a second tier of blocks upon said first tier of blocks and continuing with successive staggered tiers utilizing said alignment rails until a predetermined wall height is attained; and sealing outer side wall edges of said blocks.

10. The method of claim 9 wherein the step of attaching a starter rail upon said footer includes the step of providing a tubular channel having apertures in top and bottom walls to receive an anchor stud therethrough such that an upper portion of said anchor stud engages said bottom wall of said channel, and a lower portion of said anchor stud is anchored into said footer.

11. The method of claim 9 wherein the step of providing a plurality of blocks includes the step of positioning said recesses along a longitudinal centerline in said upper and lower planar walls of said blocks.

12. The method of claim 9 wherein the step of sealing outer side wall edges further includes the step of inserting a sealant in recesses that prevents moisture from entering gaps between adjacently positioned blocks.

13. The method of claim 9 wherein the step of sealing outer side wall edges includes the step of laying mortar between engaging portions of adjacently positioned blocks.

* * * * *